US010342281B2

(12) United States Patent
Fischer et al.

(10) Patent No.: US 10,342,281 B2
(45) Date of Patent: Jul. 9, 2019

(54) MODULAR LINER SYSTEM FOR PROTECTIVE HELMETS

(71) Applicant: VICIS, Inc., Seattle, WA (US)

(72) Inventors: Kurt Fischer, Seattle, WA (US); Kayla Fukuda, Seattle, WA (US); Mike Czerski, Seattle, WA (US); Adam Frank, Seattle, WA (US); Cord Santiago, Seattle, WA (US)

(73) Assignee: VICIS, Inc., Seattle, WA (US)

( * ) Notice: Subject to any disclaimer, the term of this patent is extended or adjusted under 35 U.S.C. 154(b) by 0 days.

(21) Appl. No.: 15/891,271

(22) Filed: Feb. 7, 2018

(65) Prior Publication Data

US 2018/0235304 A1 Aug. 23, 2018

Related U.S. Application Data

(63) Continuation of application No. PCT/US2017/042254, filed on Jul. 14, 2017.

(60) Provisional application No. 62/363,121, filed on Jul. 15, 2016, provisional application No. 62/403,115, filed on Oct. 1, 2016.

(51) Int. Cl.
*A42B 3/10* (2006.01)
*A42B 3/12* (2006.01)

(52) U.S. Cl.
CPC ..... *A42B 3/127* (2013.01); *A42B 3/10* (2013.01); *A42B 3/124* (2013.01)

(58) Field of Classification Search
CPC ..... A42B 1/08; A42B 3/125; A42B 3/127; A42B 3/128
See application file for complete search history.

(56) References Cited

U.S. PATENT DOCUMENTS

| | | | | |
|---|---|---|---|---|
| 4,283,864 A | | 8/1981 | Lipfert | |
| 4,412,358 A | | 11/1983 | Lavender | |
| 5,204,998 A | | 4/1993 | Liu | |
| 5,815,846 A | * | 10/1998 | Calonge | A42B 3/121 2/413 |
| 5,950,244 A | * | 9/1999 | Fournier | A42B 3/128 2/411 |
| 5,956,777 A | | 9/1999 | Popovich | |
| 6,029,962 A | | 2/2000 | Shorten et al. | |
| 6,530,564 B1 | | 3/2003 | Julien | |

(Continued)

FOREIGN PATENT DOCUMENTS

| | | |
|---|---|---|
| GB | 1578351 A2 | 11/1980 |
| GB | 2518668 A | 4/2015 |

(Continued)

OTHER PUBLICATIONS

PCT International Search Report and Written Opinion, PCT Appl. No. PCT/US2017/042254, dated Nov. 21, 2017, 1-14 pgs.

*Primary Examiner* — Tajash D Patel
(74) *Attorney, Agent, or Firm* — BrainSpark Associates, LLC

(57) ABSTRACT

Disclosed are methods, devices, and systems for improved protective clothing such as helmets and protective headgear, including improvements in modular, semi-custom or customized helmet liners and/or inserts to enhance wearer comfort and reduce the deleterious effects of impacts between the wearer and other players and/or objects in all types of wearer activities (i.e., sports, military, equestrian, etc.).

18 Claims, 36 Drawing Sheets

(56) References Cited

U.S. PATENT DOCUMENTS

| | | | | |
|---|---|---|---|---|
| 6,969,548 | B1 | 11/2005 | Goldfine | |
| 7,089,602 | B2 | 8/2006 | Talluri | |
| 7,516,597 | B1 | 4/2009 | Roose | |
| 7,677,538 | B2 | 3/2010 | Darnell et al. | |
| 7,802,320 | B2 | 9/2010 | Morgan | |
| 9,375,041 | B2 | 6/2016 | Plant | |
| 9,439,468 | B1 * | 9/2016 | Blagg | A42B 3/105 |
| 2006/0070171 | A1 | 4/2006 | Copeland et al. | |
| 2011/0117310 | A1 | 5/2011 | Anderson et al. | |
| 2011/0143080 | A1 | 6/2011 | Ortiz | |
| 2012/0036620 | A1 | 2/2012 | Harris | |
| 2013/0061371 | A1 | 3/2013 | Phipps | |
| 2013/0152286 | A1 | 6/2013 | Cormier et al. | |
| 2013/0185837 | A1 | 7/2013 | Phipps et al. | |
| 2014/0007322 | A1 | 1/2014 | Marz et al. | |
| 2014/0101816 | A1 | 4/2014 | Toronjo | |
| 2014/0223641 | A1 | 8/2014 | Henderson | |
| 2015/0223547 | A1 | 8/2015 | Wibby | |
| 2015/0272255 | A1 | 10/2015 | Galaitsis et al. | |
| 2015/0285697 | A1 | 10/2015 | O'Bier, II et al. | |
| 2016/0255900 | A1 | 9/2016 | Browd et al. | |
| 2016/0278470 | A1 | 9/2016 | Posner et al. | |

FOREIGN PATENT DOCUMENTS

| | | | |
|---|---|---|---|
| WO | 2010076257 | A2 | 7/2010 |
| WO | 2015069800 | A2 | 5/2015 |
| WO | 2015089646 | A1 | 6/2015 |
| WO | 2016077501 | A1 | 5/2016 |
| WO | 2017033022 | A2 | 3/2017 |

* cited by examiner

MODULAR LINER SYSTEM FOR PROTECTIVE HELMETS

CROSS-REFERENCE TO RELATED APPLICATIONS

This application claims the claims the priority of Patent Cooperation Treaty Application Serial No. PCT/US2017/42254, entitled "Modular Liner System for Protective Helmets," filed Jul. 14, 2017, which claims the benefit of U.S. Provisional Application No. 62/363,121 entitled "Modular Liner System for Protective Helmet," filed Jul. 15, 2016, and U.S. Provisional Application No. 62/403,115, entitled "Football Helmet," filed Oct. 1, 2016, and the disclosures of which are all incorporated by reference herein in their entireties.

TECHNICAL FIELD

The present invention relates to methods, devices, and systems for improved protective clothing such as helmets and protective headgear, including improvements in helmet liners and/or inserts to enhance wearer comfort and reduce the deleterious effects of impacts between the wearer and other players and/or objects. In various embodiments, improved helmet liners and fitting techniques are disclosed that can enhance athletic performance by reducing acceleration and/or dispersing impact forces on the helmet. Various designs include modular, semi-custom or customized components that can be assembled and/or integrated within a standard, customized and/or retrofitted helmet, providing for integrated and/or modular use in all types of wearer activities (i.e., sports, military, equestrian, etc.).

BACKGROUND OF THE INVENTION

Helmets and other protective clothing and related structures typically incorporate impact absorbing structures to desirably prevent and/or reduce the effect of collisions between the wearer and other stationary and/or moving objects. For example, an athletic helmet typically protects a skull and various other anatomical regions of the wearer from collisions with the ground, equipment, other players and/or other stationary and/or moving objects, while body pads and/or other protective clothing seeks to protect other anatomical regions. Helmets are typically designed with the primary goal of preventing traumatic skull fractures and other blunt trauma, while body pads and ballistic armors are primarily designed to cushion blows to other anatomical regions and/or prevent/resist body penetration by high velocity objects such as bullets and/or shell fragments.

A helmet or other protective headgear will typically include a hard or semi-hard, rounded shell with cushioning inside the shell, and typically also includes a retention system to maintain the helmet in contact with the wearer's head. When another object collides with the helmet, the rounded shape of the helmet desirably deflects at least some of the force tangentially, while the hard or semi-hard shell desirably protects against object penetration and/or distributes some amount of the impact forces over a wider area of the head. The impact absorbing structures between the helmet and the wearer's head (which typically contact both the inner surface of the helmet shell and an outer surface of the wearer's head) then transmit this impact force (at varying levels) to the wearer's head, which typically includes some level of deformation of the impact absorbing structures (as the impact forces are transferred therethrough) as well as potentially allowing direct contact between the hard shell and the head for extremely high impact forces.

A wide variety of impact absorbing structures have been utilized in protective garments and helmets over the millennia, including natural materials such as leathers, animal furs, fabrics and plant fibers. Impact absorbing structures have also commonly incorporated flexible membranes, bladders, balloons, bags, sacks and/or other structures containing air, other gases and/or fluids. In more recent decades, the advent of advanced polymers and foaming technologies has given rise to the use of artificial materials such as polymer foams as preferred cushion materials, with a wide variety of such materials to choose from, including ethyl vinyl acetate (EVA) foam, polyurethane (PU) foam, thermoplastic polyurethane (TPU) foam, lightweight foamed EVA, EVA-bound blends and a variety of proprietary foam blends and/or biodegradable foams, as well as open and/or closed cell configurations thereof.

The proper functioning of an item of protective headgear is often dependent upon the proper sizing and "fit" of the headgear to the wearer's head. A well-made but poorly fitting helmet will often not effectively protect the wearer's head from trauma and the effects of intense physical contact, as the proper sizing and fitting of a helmet to the wearer's head are typically necessary to optimize the helmet's ability to absorb and/or significantly ameliorate impacts. For example, a helmet that is too large for a wearer's head allows the user's head to move within the helmet, allowing the user's head to contact sides of the helmet during impact. Another major consideration in protective headgear is wearer comfort—if the helmet is uncomfortable or painful to wear, this discomfort may distract the user's attention (potentially leading to more severe impacts) and/or may cause the user to remove or displace the helmet prior to the moment of impact. Moreover, a helmet that is too small for the wearer's head may be uncomfortable or painful for the wearer to wear. While custom-made headgear can often be particularized and sized to an individual wearer's unique anatomy (with customization often accompanied by a hefty price tag), a less expensive mass-produced and distributed type of headgear will often be manufactured in a few standard sizes, with the closest available standard size selected for an individual wearer.

In many applications, helmets will have soft foam pads and/or inflatable liners on one or more interior surfaces that are designed to contact a wearer's head, bridging the gap between the inner helmet surface and the outer head surface and desirably providing a comfortable fit as well as helping protect the wearers' head from impact and/or injury. However, many existing designs and methodologies for selecting and sizing helmets and related interior pads/liners are cumbersome and generally ineffective in accommodating the unique shape and size of every wearer's head. Moreover, many helmet manufacturers may choose to use inexpensive and/or outdated protective technologies in the interior pads and liners, which in certain instances can greatly reduce the effectiveness of the helmet system and potentially lead to increased incidence and/or severity of injuries. In addition, conventional methods for selecting a helmet for a wearer may result in inaccurate sizing of the helmet for the wearer, allowing some movement of the wearer's head within the helmet and/or increased tightness of the helmet on the wearer's head. Accordingly, it may be desirable to maintain a number of different sizes of helmets and fitting elements, like liners and spacers, to accommodate a range of head sizes. However, maintaining an inventory of all of these differently sized elements can cause an undue burden, e.g., on a retail store or an equipment manager for a sports team.

Many football helmets are manufactured with inflatable comfort liners that may be sometimes combined with soft foam and/or other materials in an effort to help attenuate impact forces incident to the helmet. These inflatable liners can have a plurality of separate inflatable cells, with these cells adjacently arranged into a general shape inside the helmet, often with interconnect air passageways and the inflatable cells often include a separate valve-controlled inflation tube that may extend out the back or side of the helmet. To "fit" the helmet, the wearer or an assistant (often referred to as the "sizer") may increase or decrease the pressure of air or other fluid/gas within the inflatable comfort liner to desirably increase and/or decrease the size of the cells, while seeking to improve the wearer's fit, comfort and protection. Unfortunately, inflatable liners and related technology often function sub-optimally, in that the inflatable cells are prone to leakage, damage and are highly sensitive to environmental temperatures (i.e., they commonly inflate and/or deflate due to temperature fluctuations and/or air pressure changes). Inflatable cells also require an increased frequency of adjustment (or "spot checks") to maintain proper sizing in-between pressurization/depressurization cycles; they suffer from a lack of uniform inflation, where some portions of the inflatable comfort liner may be over-inflated and other portions under-inflated; and the inflatable cells are generally positioned on-top of the helmet, extending over the crown, notably causing a lift effect. Such negative characteristics of the inflatable comfort liners can adversely affect the fit of the helmet and reduce or eliminate any protection the helmet presumes to provide.

Conventional methods for sizing inflatable helmet liners to a wearer are generally cumbersome because the inflatable comfort liners of the helmet are typically integrated within the helmet, which requires the Sizer to undertake a number of steps to attain an optimal fitting of the helmet. For example, one conventional helmet sizing method requires that the Sizer (1) wrap a flexible or cloth measuring tape approximately 1" above the wearer's eyebrows to measure the circumference of the wearer's head; (2) record the measurement, and compare the measurement to the helmet manufacturer's circumference chart to select the proper size, and if the measurement falls between helmet sizes, the smaller sized helmet should be sized first; (3) put the helmet into position on the wearer's head and properly inflate one or more air liner(s) inside the helmet (with such inflation occasionally requiring application of some lubrication); (4) moving the helmet on the wearer's head to test multi-axial movement of the helmet (to verify how tightly the helmet is fit and determine if independent helmet movement or slippage is allowed); (5) and then repetition of this process if unwanted movement is observed. The Sizer will then again repeat this process for each air liner in the helmet, and will also need to verify that the helmet's front edge is positioned a desired distance above the wearer's eyebrows to allow for proper visibility. This process must occur before each use of the helmet, and must also be repeated a number of times during the athletic activity, including after significant exertion by the wearer occurs, after each significant impact to the helmet, and after each time that the environmental air temperature and/or pressure changes significantly. In addition to the large number and frequency of these checks, manufacturers, retailers and equipment managers are often forced to stock a large number of helmet components and fitting elements, and are often obligated to use a wide variety of charts and inventory software to keep track of the large number of helmet sizing options to accommodate a range of head sizes. This causes an undue burden to all involved parties, including a need for maintaining an inventory of many differently sized helmets and/or elements as well as forcing equipment managers to carefully follow instructions and inspection checklists.

Conventional methods for properly sizing a helmet to a wearer are also typically inaccurate because they only measure the circumference of the head, which identifies the largest and/or widest cross-section of the wearer's skull, and these methods typically ignore any variations in the shape and/or surface features of the wearer's head. Such inaccurate measurements often lead to improperly fitted helmets, and improperly fitted helmets can lead to increased opportunity for head injuries. More specifically, improperly fitted helmets may transmit increased forces to the wearer's head, including rotational forces that may "overpower" the wearer's cervical muscles in their neck and head, and which may cause excessive damage to the brain.

BRIEF SUMMARY OF THE INVENTION

There is a need, therefore, for an improved system and methods for sizing and fitting helmets and other protective headgear for a wearer, which desirably takes into account the shape, size and anatomical variation of the wearer's skull. In various embodiments, a modular comfort liner system, associated sizing/fitting methods and associated fitting system are disclosed which incorporates features to improve and/or enhance comfort, fit, and attenuation in response to high intensity and/or repetitive impact events.

Various embodiments disclosed herein include a unique liner and helmet system, with associated methods and procedures for measuring, selecting and sizing a liner system for use in protecting the head of a wearer. In one exemplary embodiment, the helmet liner system can include a helmet and a liner; the helmet having an outer shell, an inner shell and a compressible structure disposed between the inner and outer shell; the liner having a having a plurality of segments surrounding the circumference of the wearer's head. Such plurality of segments may include a frontal segment (or front segment or front pad), an occipital segment (or back segment or back pad), a parietal segment (or midline segment or midline pad), and a temporal segment (or side segments or side pads), and/or any combination(s) thereof. At least a portion of the liner may be coupled to one or more of the inner shell, reflex layer(s) and/or outer shell to facilitate energy absorption, reduce angular motion of the wearer after impact, enhance fit and comfort.

The associated methods and procedures for measuring, selecting and sizing a liner system may improve the comfort and fit around the circumference of a wearer's head so the helmet more securely contacts the wearer's head. Sizing can include measurements of length and breadth of a head of the wearer. Different sizes of helmet can be associated with different combinations of length and breadth for head sizes and shapes. For example, different shells of the helmet, each having different sizes, can be associated with different combinations of length and breadth measurements for head size. To allow the helmet to more securely fit a wearer's head, different liners may be attached to an interior surface of the helmet, so a surface of a liner attached to the interior surface of the helmet contacts portions of a wearer's head when the helmet is worn. A suitable liner can comprise a flexible layer with at least one deformable material layer, such as foam (e.g., low resilience open cell polyurethane foam), coupled to different regions of the flexible layer. In various embodiments, the deformable material may contain two or more deformable material layers, where a first layer is configured to absorb energy after impact, and the second layer may be configured for fit. In one example, the second layer of deformable material may comprise a threshold recovery time, so the second layer of deformable material returns to its original shape after compression in at least the threshold recovery time. In various embodiments, the deformable material is coupled to regions of the flexible layer so the deformable material uniformly distributes force around the circumference of wearer's head when force is applied to the helmet. In various embodiments, the first layer and the second layer can comprise different types, arrangements and/or compositions of deformable materials, including foam materials such as polyurethane foams, high density foams, Evlon or Lux foam, high resilience foams, later rubber foams, Supreem foams, Rebond foams, memory foams, closed cell foams, open cell foams and/or dry fast foams. If desired, the first and second layers may comprise foam materials having differing densities, differing pore sizes, differing tensile strengths, differing elongation values, differing tear strengths, differing compression resistances, differing compression sets and/or differing rebound rates or recovery times.

In various embodiments, the liner may be fully integrated and/or modular. Modularity of the liner components allows the wearer to easily replace portions of the deformable material layer coupled to different regions of the liner with alternative deformable material(s) having a different thickness, one or more deformable layers and/or other different properties (e.g., liners of different size, shape and/or recovery time) to further customize a fit of the helmet for the wearer. Furthermore, the modular liner may incorporate removably detachable features. At least a portion of the liner may include individual detachable features such as elastic and/or detent tabs, hook and loop fastener systems, and/or attachment posts. In various embodiments, the liner segments can be individually installed on the inner shell and/or outer shell of a helmet or other helmet location using attachment posts that fit into a standard hole arrangement on each helmet size. Elastic or detent tabs (and/or detachable fasteners such as hook and loop fasteners) can be sewn into one or more of the liner segments and may be connected to neighboring liner segments to provide more structural integrity for the liner system and prevent slippage of the liner segments during use.

In various embodiments, a liner of a helmet can include various optimal features, such as an occipital contact region and/or a frontal contact region that increases a surface area of the liner contacting the wearer's head while reducing movement of the wearer's head between a front surface of the helmet and a rear surface of the helmet. For example, the occipital contact region can comprise a deformable material coupled to a region of the liner's flexible material that is coupled to a portion of a helmet shell positioned proximate to a rear of a wearer's head. In various embodiments, the occipital contact region could be a piece of the deformable material separate from pieces of deformable material coupled to other regions of the flexible layer of the liner. In other embodiments, the occipital contact region may have a wedge shape in various embodiments. Various mechanisms may be used to secure the occipital contact region to the liner or between the liner and a wearer's head in different embodiments.

DETAILED DESCRIPTION OF THE INVENTION

Figure 1:
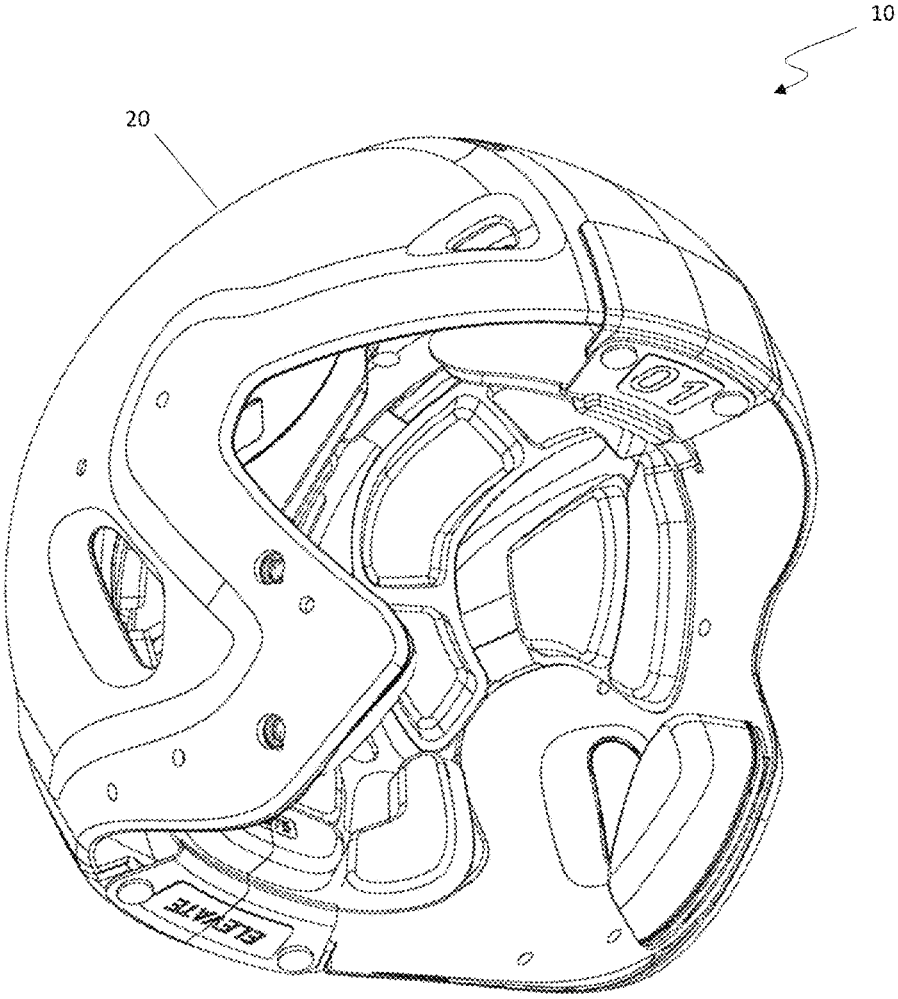
FIG. 1 depicts a perspective view of one exemplary embodiment of a protective helmet configured for the sport of football.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding the methods disclosed, the order of the steps presented is exemplary in nature, and thus, the order of the steps can be different in various embodiments. Except where otherwise expressly indicated, all numerical quantities in this description indicating numerical values are to be understood as describing the broadest scope of the technology disclosed herein.

A helmet for protecting a wearer's head is disclosed. In various embodiments, the helmet will include an outer shell comprising one of a series of outer helmet shells (i.e., manufactured in a series of standard sizes and/or shapes) with at least one impact absorbing layer positioned inside of the shell (i.e., between the outer shell and the wearer's skull). A modular impact liner system and associated components are also desirably disposed within the helmet shell, and in various embodiments components of the modular impact liner system are positioned between the impact absorbing layer and the wearer's skull. In various embodiments, the impact liner system includes a variety of components of differing sizes, shapes and/or configurations, which desirably can be "mixed and matched" in various combinations to create an impact liner construct that matches or substantially matches various external anatomical features of the wearer's head. By creating a structure that matches or substantially matches the wearer's head, the disclosed system and methods can optimize the fit of a standardized helmet shell to the wearer's unique anatomy, thereby improving wearer comfort and enhancing performance of the impact absorbing and/or other protective features of the helmet.

In various embodiments, the combination of the disclosed impact absorbing structures with the modular impact liner systems described herein can decrease impact forces, such as linear and angular acceleration. The impact absorbing structures and modular impact liner system can comprise a composite, multi-layered system that reduces the peak impact loading, rotational acceleration, rotational strain rate and/or rotational strain that can result in a concussion or other brain injury. In a properly equipped and fitted helmet, the disclosed technology offers greater injury protection, performance, and personal comfort than existing protective systems. In various embodiments disclosed herein, use of a modular impact liner system and associated impact absorbing structures within a football helmet can provide up to a 50% or greater reduction in peak impact and/or rotational impact force(s) transferred to a wearer's skull, which can greatly reduce acceleration to the brain from an impact.

In various alternative embodiments, the disclosed modular impact liner systems and associated components could potentially be utilized and/or retrofitted into standard and/or customized helmets and/or helmet shells, including, but not limited to, helmets currently available from such manufacturers as Riddell, Schutt, Rawlings, Xenith, and SG Helmets, if desired. In such a case, the various components of the modular impact liner system could be positioned underneath the helmet and/or existing padding provided within the helmet, or some or all of the existing materials could be removed and replaced with various modular components, with or without associated impact absorbing structures. In certain embodiments, the modular impact liner system could include thin hybrid components and/or layers which could be positioned underneath the helmet and any padding provided within the helmet.

The various components of the modular impact liner system can be removably inserted into the helmet, can be permanently affixed to the helmet and/or can be removably or permanently affixed to one or more impact absorbing system components positioned within the helmet (which themselves may be permanent and/or removably affixed to the inner helmet surface and/or other portions of the helmet.

Disclosed herein are various embodiments of helmets incorporating a variety of modular impact liner components and systems for helmets and other headgear, including various systems and methods for selecting, sizing and fitting a helmet for an individual wearer. In various embodiments, helmets with modular impact liner systems can further include energy management structures for a helmet such as impact absorbing structures and/or buckling structures. In various embodiments disclosed herein, the impact liner system is described for use with a protective sport helmet such as a football helmet, although various other embodiments could be utilized with protective headgear for other sports such as lacrosse, hockey, multi-sport, cycling, white-water, climbing, softball and/or baseball helmets. Various embodiments could be utilized for safety helmets, such as industrial or construction helmets, and also for a variety of security and/or military uses such as for military helmet shells including the US Army Advanced Combat Helmet (ACH), the US Marine Corp Lightweight Helmet (MLH), the Enhanced Combat Helmet (ECH), the Personal Armor System for Ground Troops (PASGT) helmet, and/or any other ballistic and/or non-ballistic helmet shells.

Figure 2A:
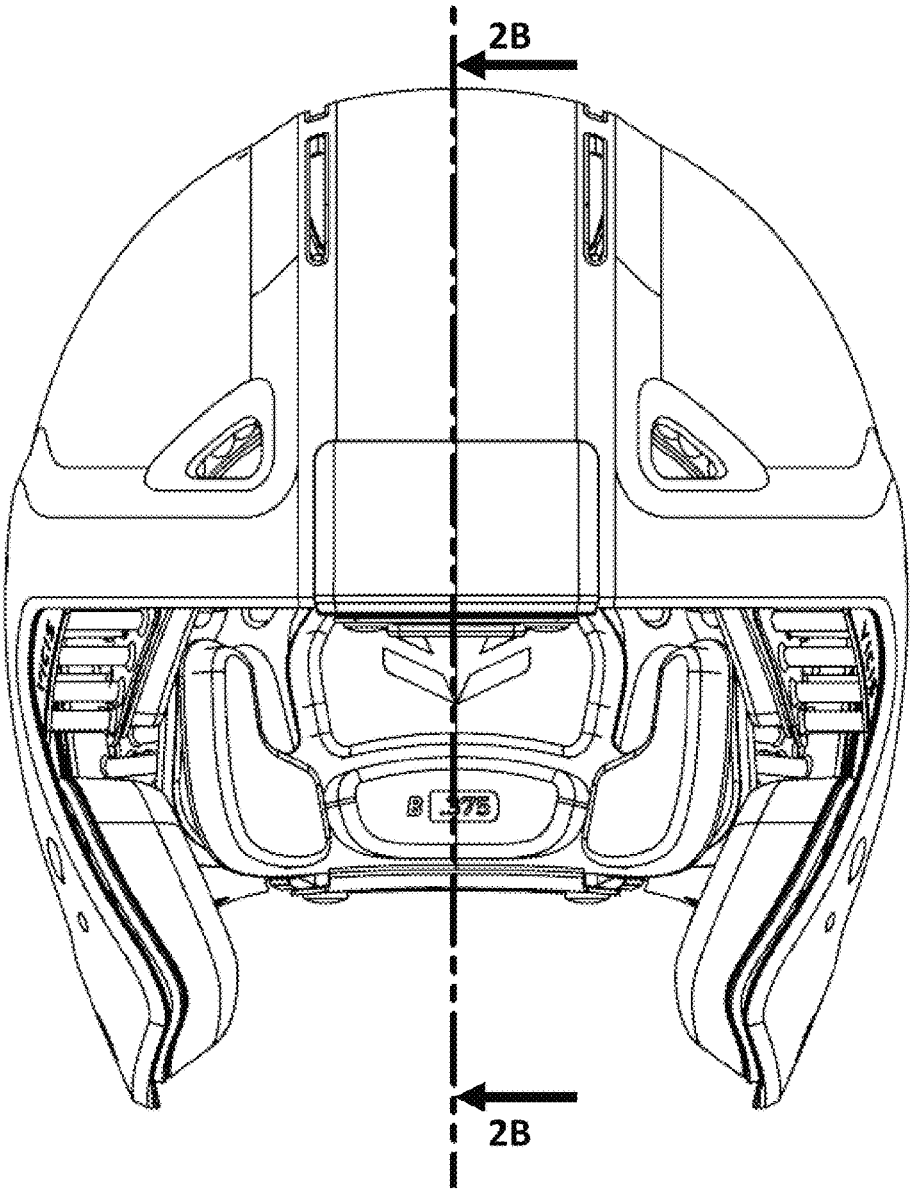
FIG. 2A depicts a front plan view of the helmet of FIG. 1.
Figure 2B:
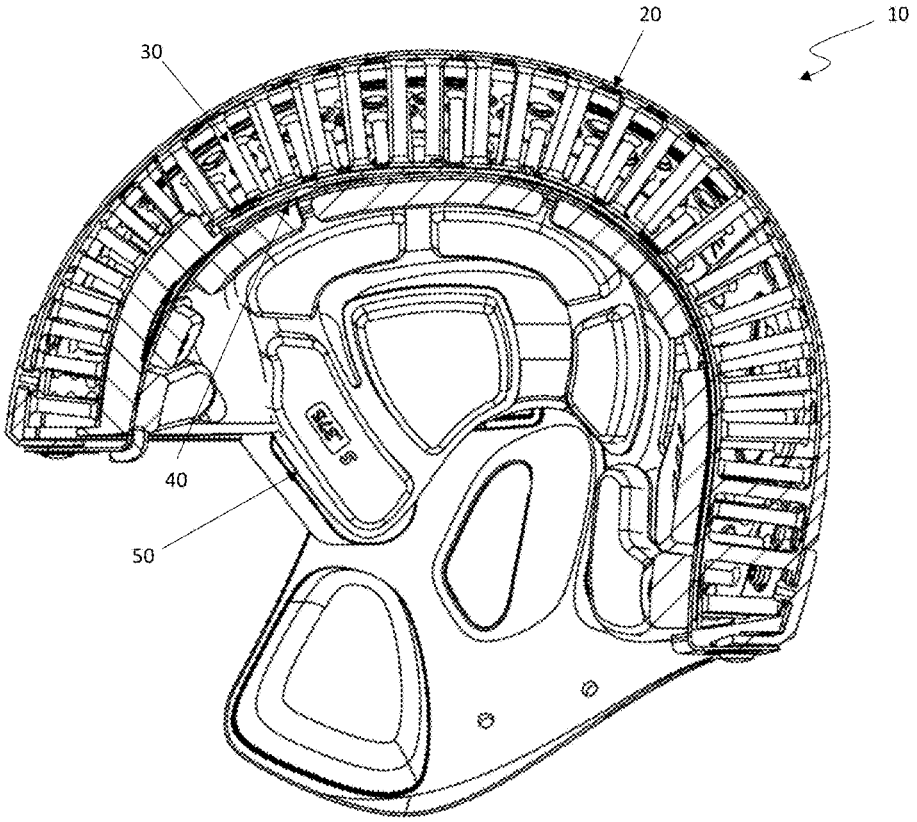
FIG. 2B depicts a side cross-sectional view of the helmet of FIG. 2A, taken along line 2B-2B of FIG. 2A.
Figure 3A:
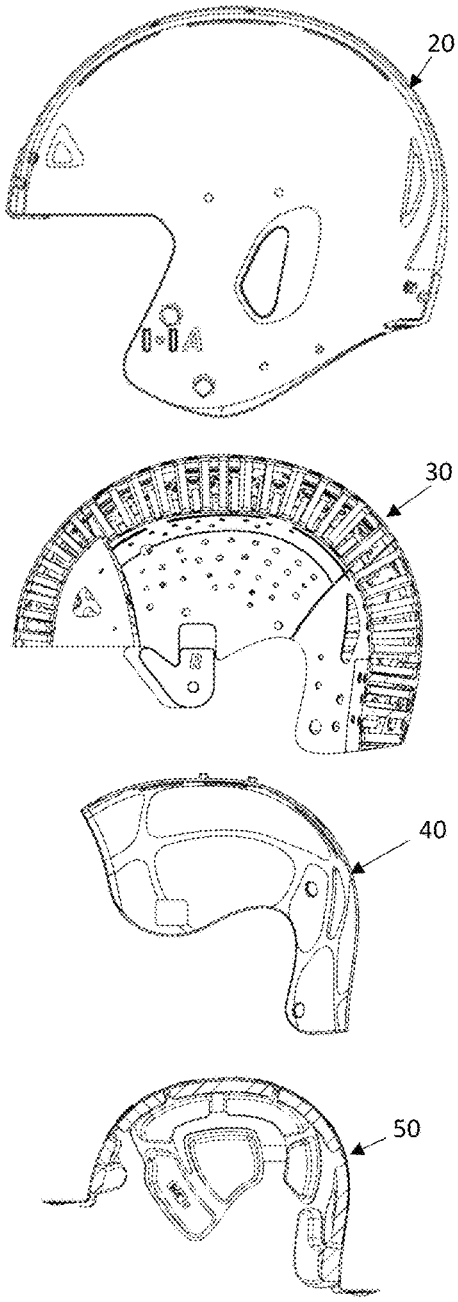
FIG. 3A is a partially exploded cross-sectional view of the helmet of FIG. 1, showing various helmet layers.
Figure 3B:
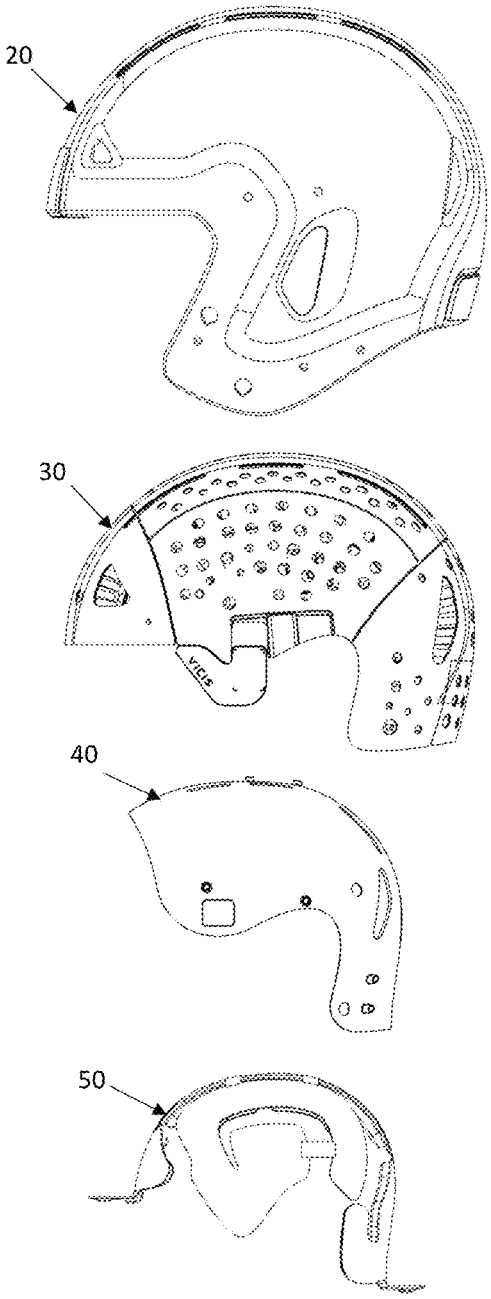
FIG. 3B is a partially exploded side plan view of the helmet of FIG. 1, showing various helmet layers.

FIG. 1 depicts a perspective view of one embodiment of a protective helmet 10 configured for the sport of football, wherein an outer protective shell 20 covers a portion of the head of a wearer, and a mask (not shown) covers a face portion of the wearer and is coupled to the shell in a variety of well-known ways. FIG. 2A depicts a front plan view of the helmet of FIG. 1, and FIG. 2B depicts a side cross-sectional view of the helmet of FIG. 2A, taken along line A-A of FIG. 2B. As best seen in FIGS. 2B, 3A and 3B, the helmet 10 can be a layered construct comprising an outer helmet shell or load shell 20, one or more impact absorbing structure layers or reflex layers 30 inside of the load shell, an inner shell or cap 40 within the reflex layer, and an inner modular impact liner system 50. FIG. 3A depicts cross-sectional side views of these components in a partially-exploded layered view, and FIG. 3B depicts side plan views of these components in the same partially-exploded layered view.

In the disclosed embodiment, the outer helmet shell 20 can comprise a semi-rigid, flexible or semi-flexible layer which can desirably flex and/or deform to varying degrees from an impacting force, with the inner shell 40 comprising a relatively rigid cap structure. However, in alternative embodiments, the outer helmet shell and/or inner shell could comprise one or more relatively rigid components, sheets and/or plates, or could comprise a layered construct of one or more flexible and/or semi-flexible components, as desired. In between the inner shell/wearer and the outer shell, various impact absorbing materials, impact absorbing structures (IAS) and/or combinations of impact absorbing materials and impact absorbing structures may be placed to increase comfort for the wearer and reduce or ameliorate the transmission of impact forces to the wearer's anatomy. Hereinafter, these impact absorbing material and structures are collectively referred to as one or more reflex layers 30 (also referred to as "an IAS array").

Figure 4A:
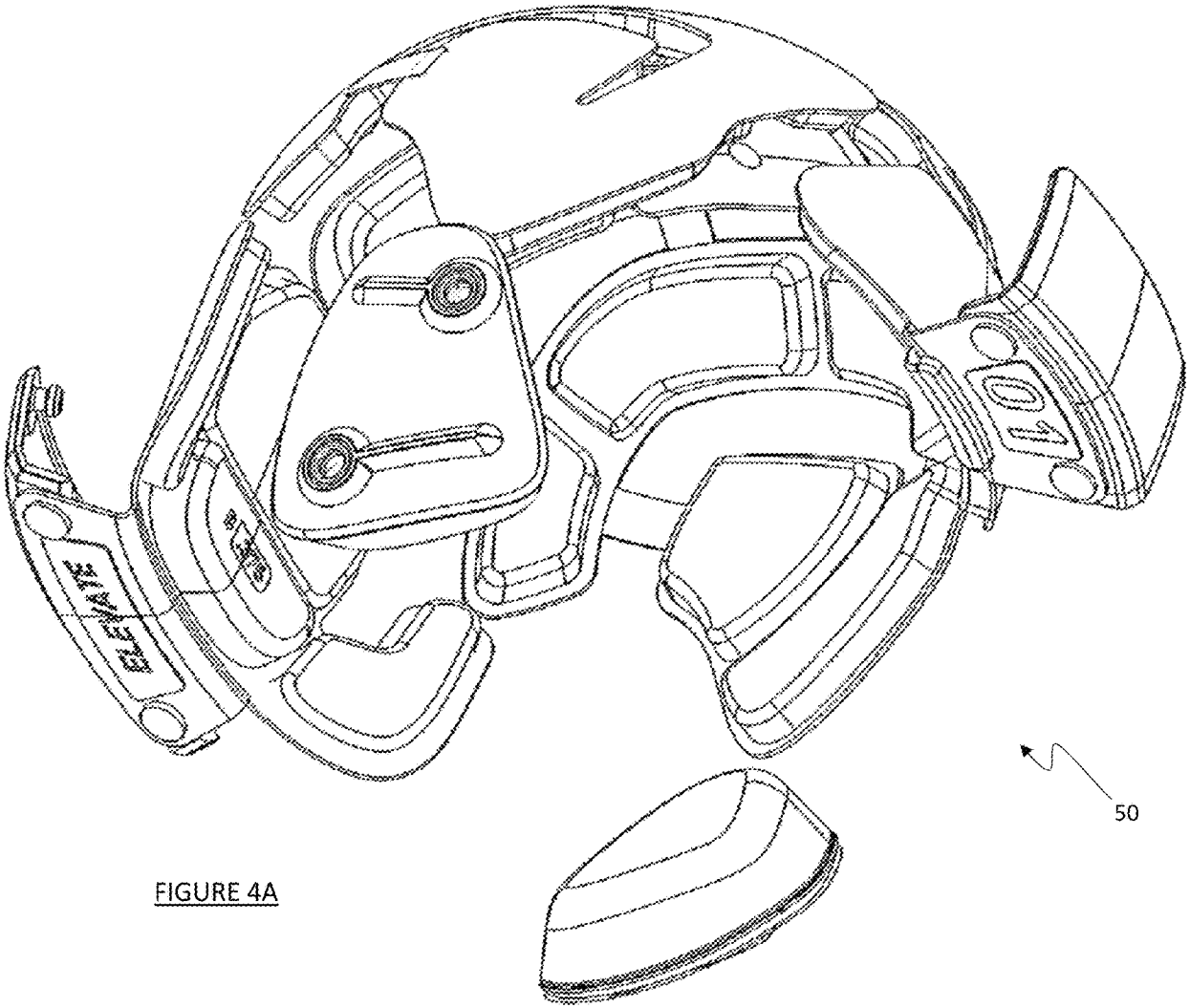
FIGS. 4A and 4B depict perspective and exploded views of one exemplary embodiment of a modular impact liner system.
Figure 4B:
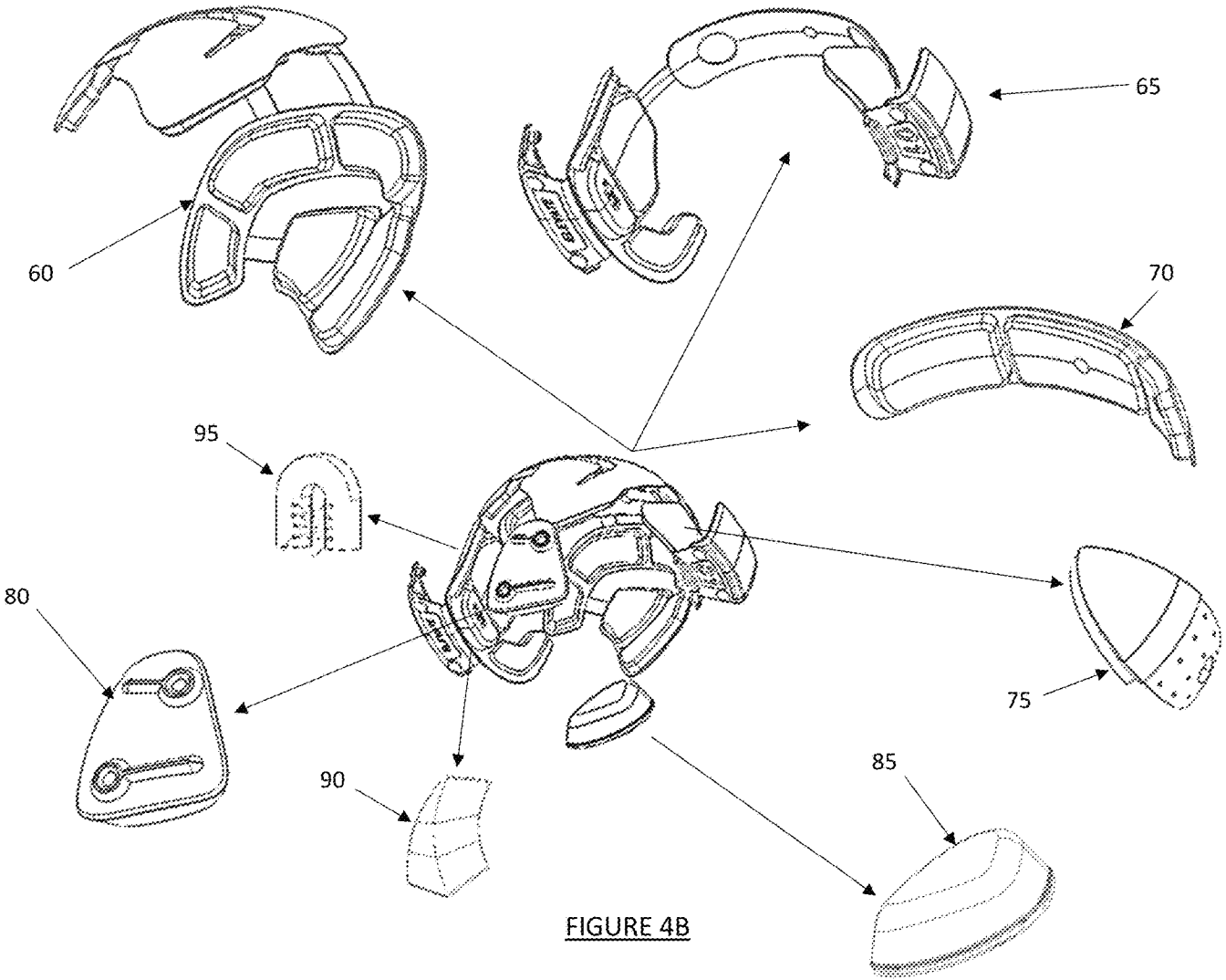

As best seen in FIGS. 3A and 3B, an inner modular impact liner system 50 can be positioned within the interior of the helmet, with various portions of the structures in the system desirably in contact with the wearer's head. In some embodiments, various components of the liner system 50 can be connected and/or attached to a variety of locations and/or components of the helmet, including connections to the inner shell 40, to the reflex layer(s) 30 and/or to the outer helmet shell 20. FIGS. 4A and 4B depict one exemplary embodiment of a modular impact liner system 50, which includes a variety of components, including a right/left liner assembly 60, a front/back liner assembly 65, a ridge or midline pad assembly 70, an impact pad assembly 75, a right jaw pad assembly 80 and a left jaw pad assembly 85. Also shown are various optional components of the system 50, including a wedge pad assembly 90 and a corset pad assembly 95.

In at least one exemplary modular liner system, the helmet assembly could include a plurality of liner components, such as the various components previously described. If desired, the system may further include a series of similarly shaped liner components (corresponding to each of the described pad assemblies) having different pad thicknesses in some or all of the pads, such as a series of three midline pad assembly components having differing thicknesses (i.e. the system could have three different "copies" of the midline pad assembly as selectable components, including a "small" first midline pad assembly having pads with a thickness of 0.375 inches, a "medium" midline pad assembly including pads having a thickness of 0.500 inches and a "large" midline pad assembly with pads having a thickness of 0.625 inches). In one exemplary embodiment, the modular liner system could include three different thickness versions for each liner component, leading to a modular liner system comprising a total of 15 liner components, which can be mixed and/or matched to accommodate virtually any size and/or shape of head.

Figure 5C:
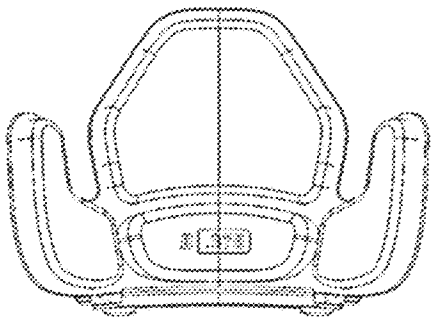
FIGS. 5A through 5E depict various views of one exemplary embodiment of a back pad assembly.
Figure 5D:
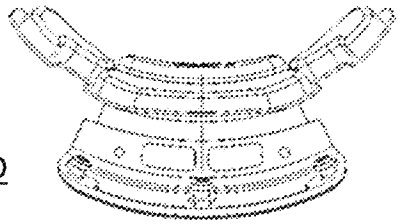
Figure 5A:
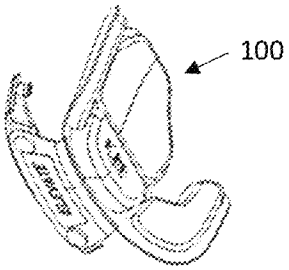
Figure 5E:
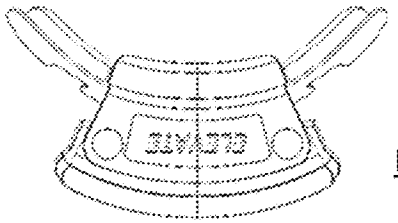
Figure 5B:
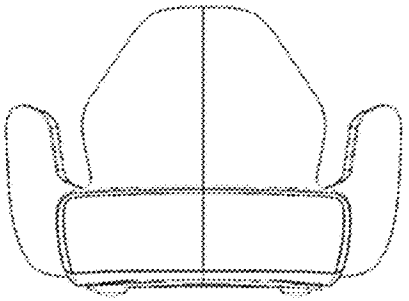
Figure 5F:
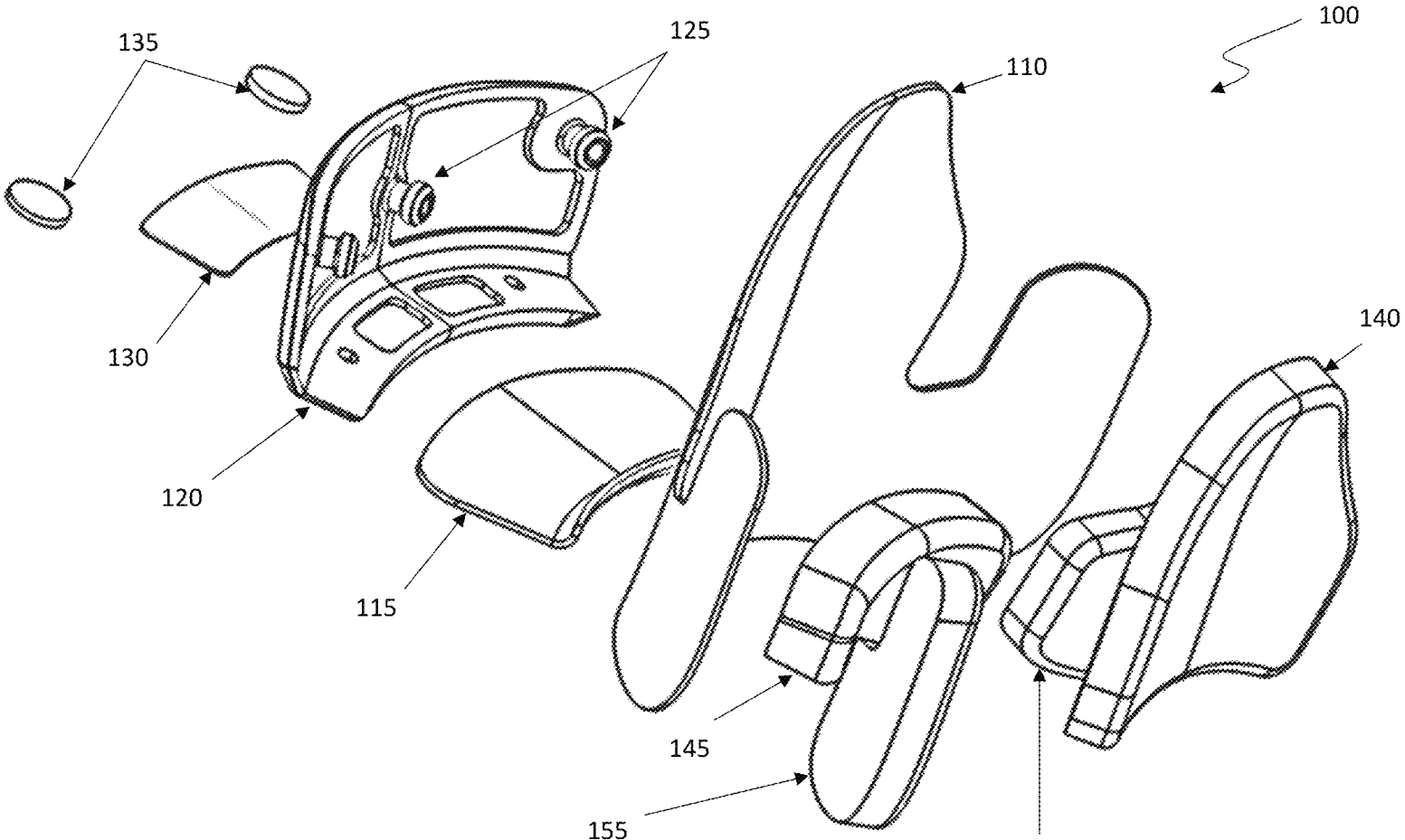
FIG. 5F depicts an exploded view of the back pad assembly of FIG. 5A.

FIGS. 5A through 5E depict various views of one exemplary embodiment of a back pad assembly 100 of the front/back liner assembly 65. As best seen in the exploded view of FIG. 5F, the back pad 100 includes a rear baseplate 110, a lower ridge plate 115 and a rear mounting plate 120. The rear mounting plate 120 includes a plurality of mounting or push tabs 125, which desirably fit into corresponding openings (not shown) in the helmet, and a logo plate 130 and a pair of snap fit buttons or discs 135 are disposed on the rear mounting plate 120, wherein the lower surface can include removable mounting features such as hook and loop or magnetic fastener, or alternatively the logo plate can be permanently affixed using adhesive or other attachment means. A plurality of comfort pads or liner segments can be disposed on a wearer-facing surface of the rear baseplate 110, which in this embodiment comprise a central rear pad 140, a lower rear pad 145, a left rear pad 150 and a right rear pad 155, each of which can be removably and/or permanently affixed to the rear baseplate 110.

The rear baseplate 110, a lower ridge plate 115 and a rear mounting plate 120 can be manufactured from various substantially rigid and/or rigid materials. Such materials may be polymers (e.g., polycarbonate) and/or metals (e.g. stainless steel) that allow the comfort pads to be affixed and/or mounted using a variety of attachment methods, such as push tabs, snap fit buttons, hook and loop fasteners, magnetic fasteners, and/or any combination thereof.

In various embodiments, the components of the inner modular impact liner system 50 will desirably comprise relatively deformable, flexible and/or semi-flexible materials, especially those materials in close proximity to and/or in contact with the wearer's head. Such components can comprise flexible and/or semi-flexible materials, fabrics and/or deformable foams such as polyurethane foams and/or memory foams. In various embodiments, some components may comprise less-flexible and/or rigid materials, such as attachment pins and/or connecting/support plates. In one exemplary embodiment, the comfort pads within the liner system may have at least one deformable material that may be configured for comfort and dissipation of impact forces. Alternatively, the comfort pads may have two or more deformable materials that are configured for comfort and dissipation of impact forces. For example, one deformable pad may comprise a first and a second deformable material. The first deformable material may be a memory foam, which is a polyurethane, viscoelastic foam that may rebound after compression, as well as may have heat reactive characteristics (e.g., it absorbs heat and softens once it gets warmed). The second deformable material may be a polyurethane foam, which may be configured to have compressive strength to absorb and/or dissipate impact forces. Such polyurethane foam also may contain other characteristics, including a lower weight reduction, comfort, moisture and heat resistance, sound/vibration absorption, and/or durability. The at least one deformable material thickness may range from 0.00625 in. to 1 in. Furthermore, all comfort pads may be encapsulated with a mesh material to facilitate breathability, moisture evaporation and/or wicking of heat and/or sweat.

In various embodiments, shear responsive materials may be incorporated into various components of the outer helmet, reflex layer, inner helmet and/or liner components, including materials that stiffen and/or harden in response to impact forces such as PORON XRD urethane (commercially available from Rogers Corporation of Rogers, Conn., USA). Such materials may allow for flexibility and/or softness of various structures under normal wear and/or use, with alterations in the stiffness or other material properties occurring in the material in response to an impact and/or other external or internal factor. In at least one exemplary embodiment, a Poron XRD foam can be incorporated into one or more layers of the comfort pads or liner segments described herein. If desired, other strain hardening and/or impact-hardening materials may be incorporated therein, including D3O (commercially available from Design Blue Ltd of Brighton and Hove, United Kingdom), PORON XRD and/or DEFLEXION silicon-based impact protection textile (commercially available from Dow Corning Corporation of Corning, N.Y., USA).

Figure 6D:
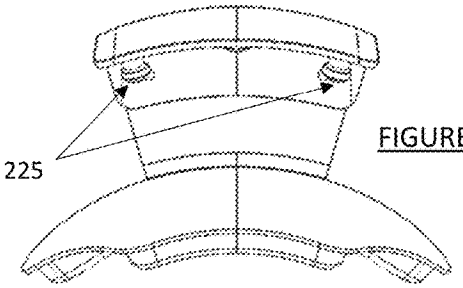
FIGS. 6A through 6E depict various views of one exemplary embodiment of a front pad assembly.
Figure 6A:
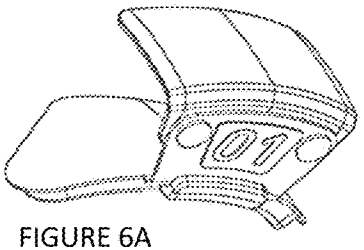
Figure 6C:
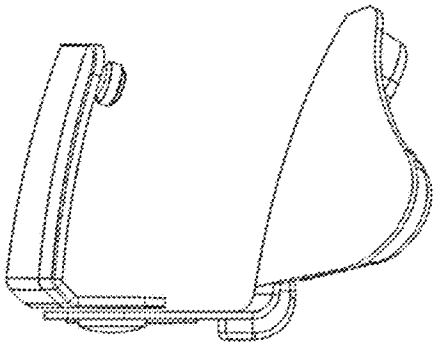
Figure 6E:
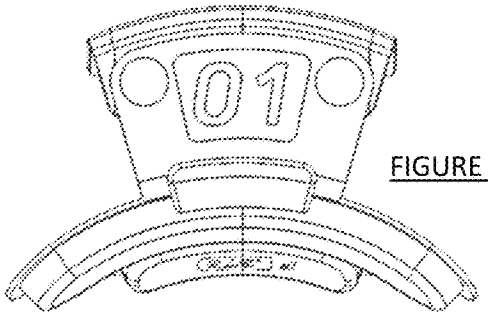
Figure 6B:
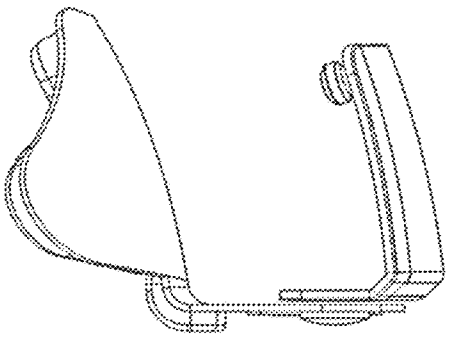
Figure 6F:
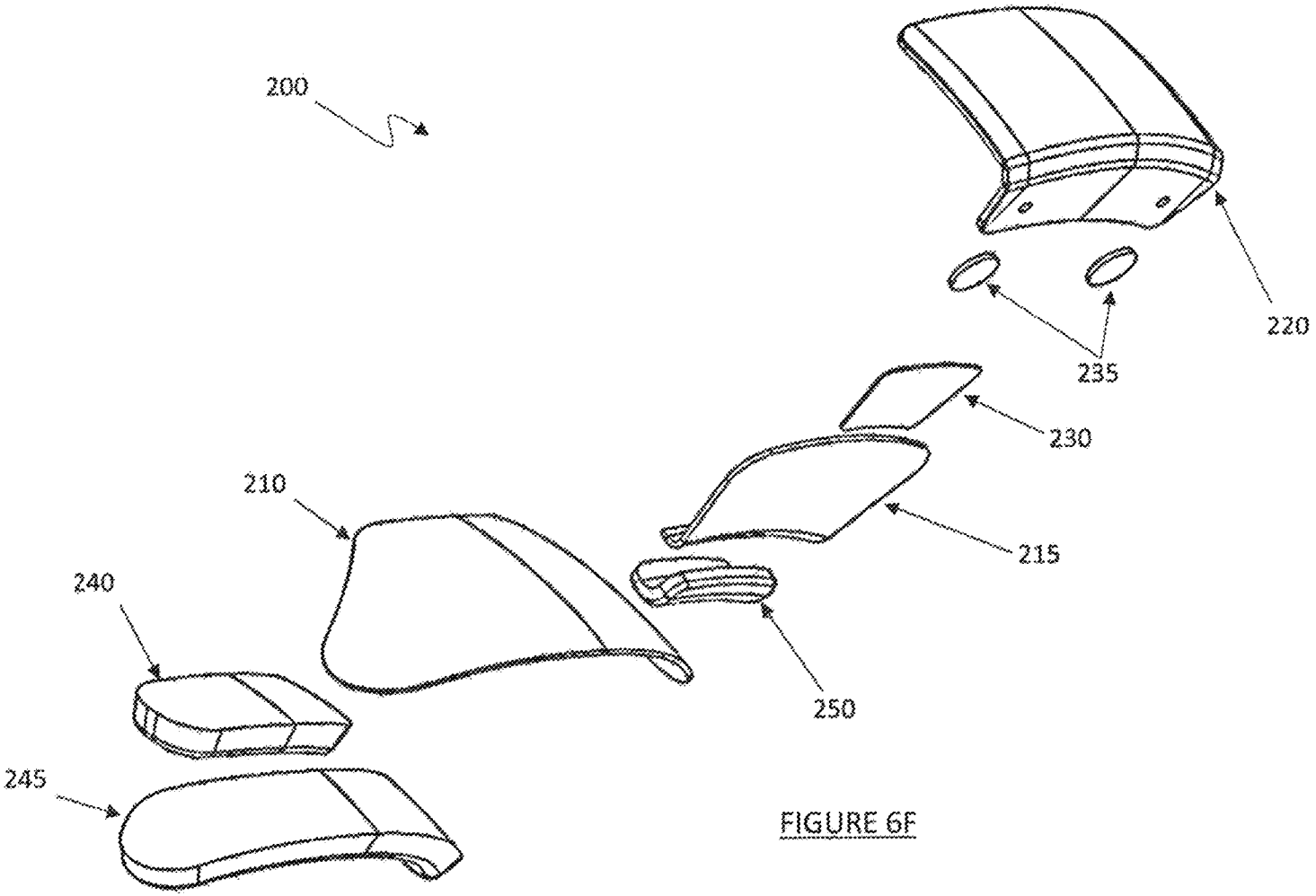
FIG. 6F depicts an exploded view of the front pad assembly of FIG. 6A.

FIGS. 6A through 6E depict various views of one exemplary embodiment of a front pad assembly 200 of the front/back liner assembly 65. As best seen in the exploded view of FIG. 6F, the front pad 200 includes a front baseplate 210, a front ridge plate 215 and a front mounting plate 220. The front mounting plate 220 can include a plurality of mounting or push tabs 225 (see FIG. 6D), which desirably fit into corresponding openings (not shown) in the helmet, and a logo plate 230 and a pair of snap fit buttons or discs 235 are disposed on the front ridge plate 215, wherein the lower surface can include removable mounting features such as hook and loop or magnetic fastener, or alternatively the logo plate can be permanently affixed using adhesive or other attachment means. The front baseplate 210, a front ridge plate 215 and a front mounting plate 220 may be customized to an individual wearer, i.e., displaying a specific wearer's player number and/or initials, etc. A plurality of comfort pads can be disposed on a wearer-facing surface of the front baseplate 210, which in this embodiment comprise an upper front pad 240, a mid-front pad 245, and a curved lower front pad 250, each of which can be removably and/or permanently affixed to the front baseplate 210 and/or front ridge pad 215.

Figure 7A:
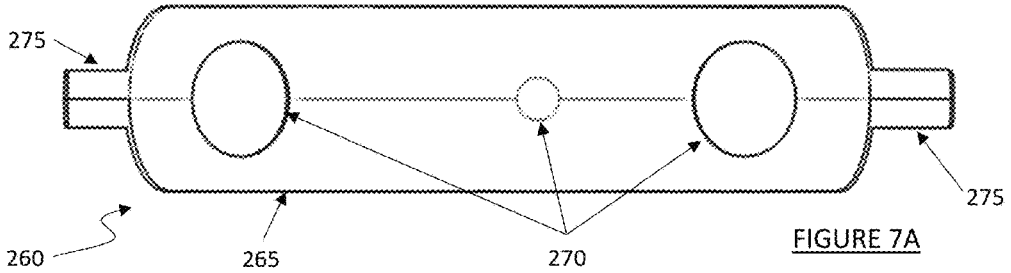
FIGS. 7A through 7C depict various views of one exemplary embodiment of a front/back strap.
Figure 7B:
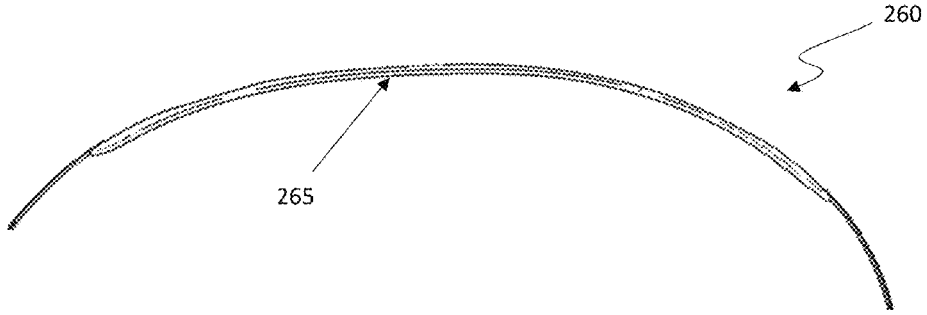
Figure 7C:
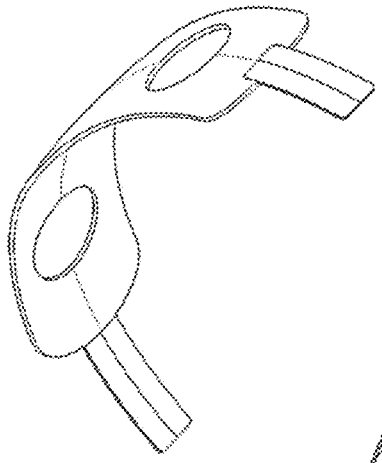
Figure 7D:
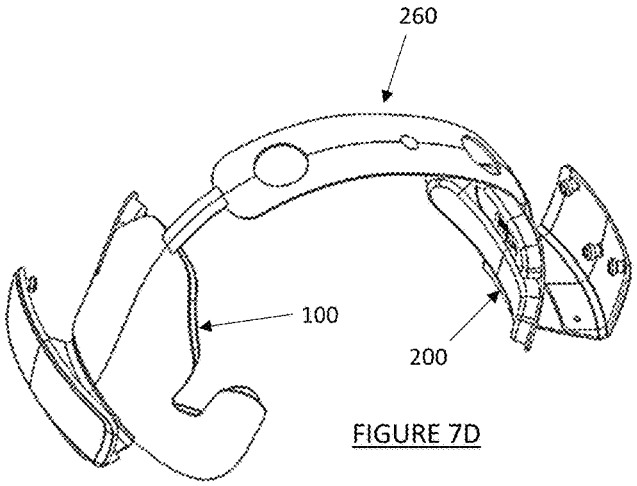
FIG. 7D depicts a perspective view of one exemplary embodiment of an assembled front/back liner assembly.

In addition to the back and front pad assemblies 100 and 200, the front/back liner assembly 65 includes a front/back strap 260 which connects the back-pad assembly 100 to the front pad assembly 200. FIGS. 7A through 7C depict various views of a front/back strap 260, which includes a central body 265 comprising a relatively flattened, flexible material or textile, with a plurality of holes 270 formed therethrough. At each end of the central body 265, a strap 275 is disposed, which in various embodiments can comprise a flexible, elastic and/or stretchable fabric, with the terminal end of each strap connected to the relevant pad assembly (i.e., by stitching, adhesive and/or removable connections), as best shown in FIG. 7D.

Figure 8D:
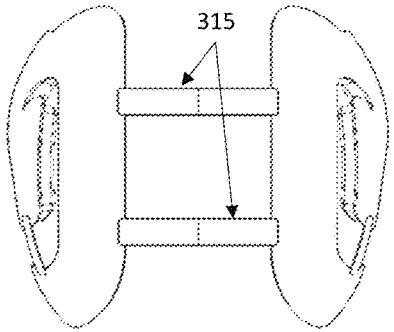
FIGS. 8A through 8E depict various views of one exemplary embodiment of a side assembly.
Figure 8A:
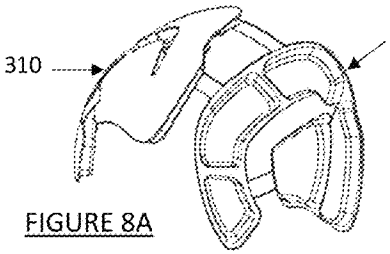
Figure 8C:
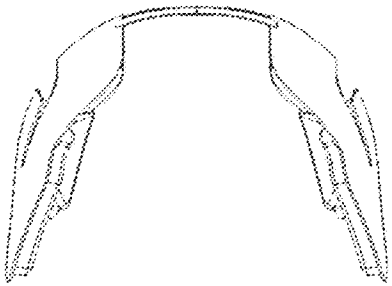
Figure 8E:
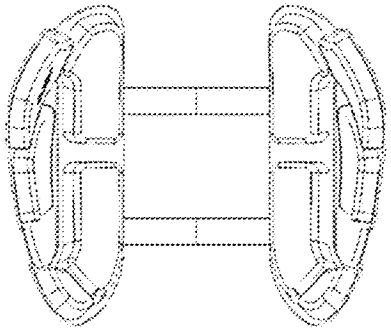
Figure 8B:
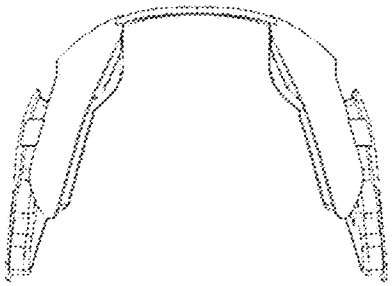
Figure 8F:
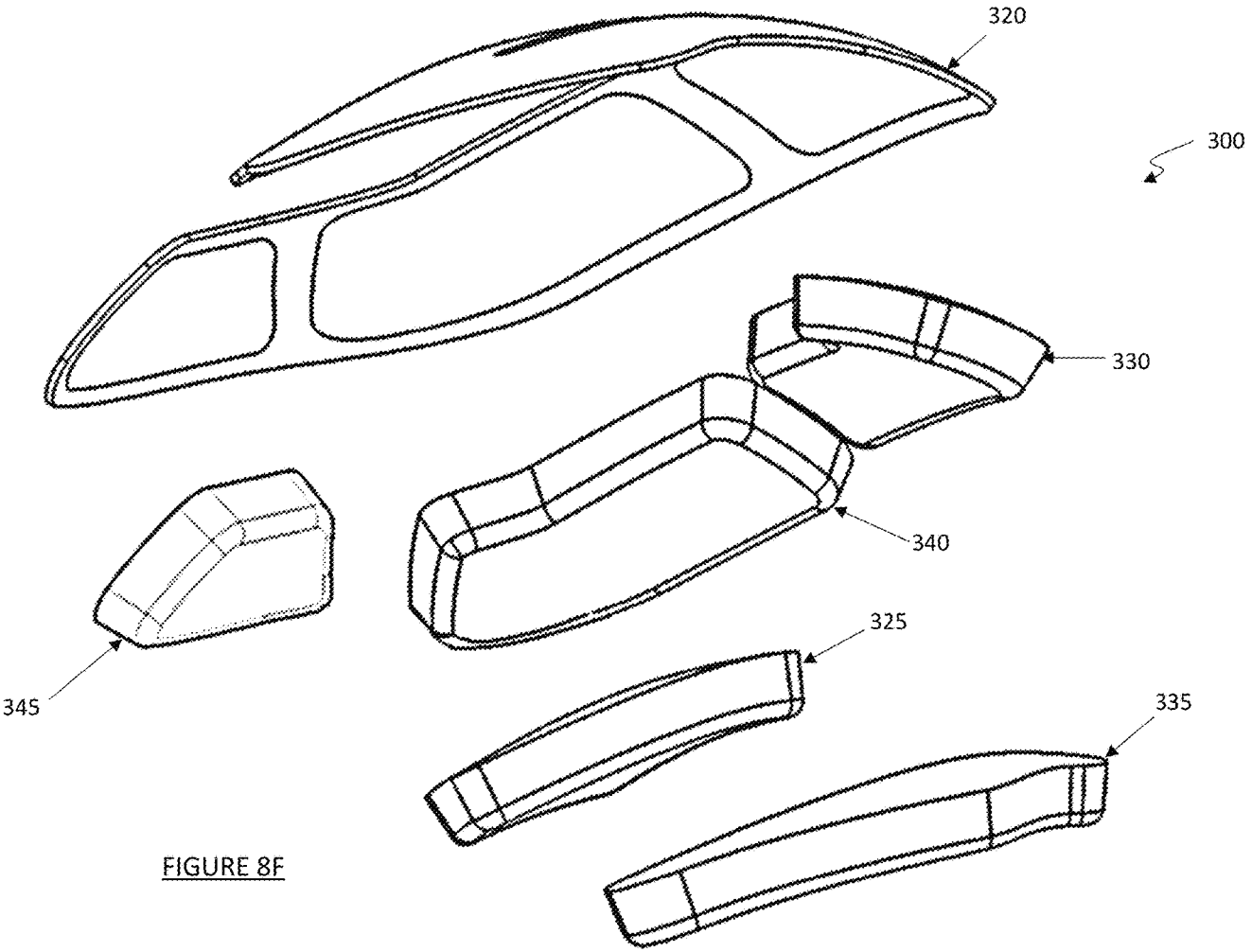
FIG. 8F depicts an exploded view of the side assembly of FIG. 8A.

FIGS. 8A through 8E depict various views of one exemplary embodiment of a side assembly 300 of the right/left liner assembly 60. While the embodiment depicted includes a mirror-image pair of a left-side assembly 305 and a right-side assembly 310, it should be understood that the left and right-side assemblies need not necessarily be mirror images of each other. In alternative embodiments, the left and right-side assemblies could be designed and/or configured differently, such as where one or more of the individual pads of each assembly could differ in shape and/or size, could be positioned in different locations on the assemblies, and/or where the thicknesses of individual pads on the left and right assemblies could differ relative to each other and/or to a corresponding pad on the opposing assembly. Desirably, the left and right-side assemblies of the right/left liner assembly 60 are connected together by one or more connecting straps 315, which in various embodiments can comprise a flexible, elastic and/or stretchable fabric, with the terminal end of each strap connected to the relevant pad assembly (i.e., by stitching, adhesive and/or removable connections), as best shown in FIG. 8D As best seen in the exploded view of FIG. 8F, the side assembly 300 (which is configured as a right-side assembly in this figure) comprises a curved side mounting plate 320, with a plurality of comfort pads disposed on a wearer-facing surface of the plate 320. In this embodiment, the comfort pads comprise a center side pad 325, an upper front side pad 330, a lower front side pad 335, an upper rear side pad 340 and a lower rear side pad 345.

Figure 9D:
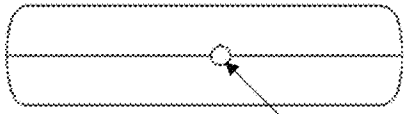
FIGS. 9A through 9E depict various views of one exemplary embodiment of a ridge pad assembly.
Figure 9A:
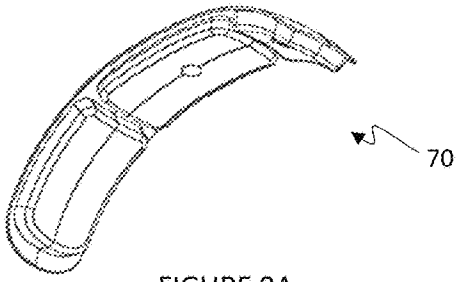
Figure 9C:
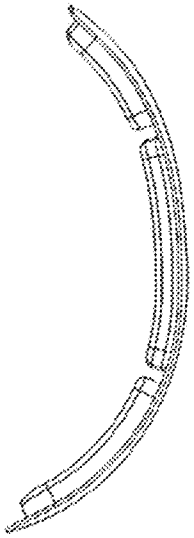
Figure 9E:
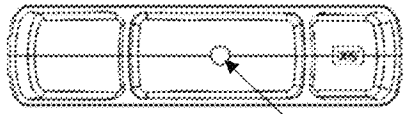
Figure 9B:
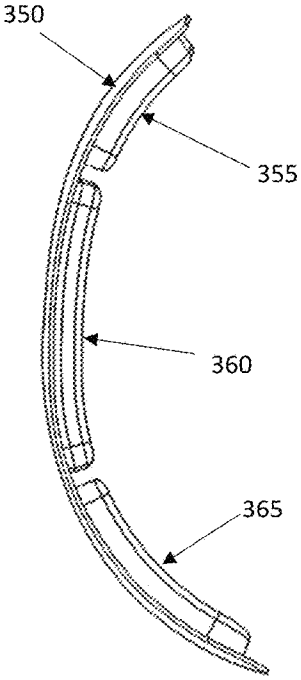
Figure 10B:
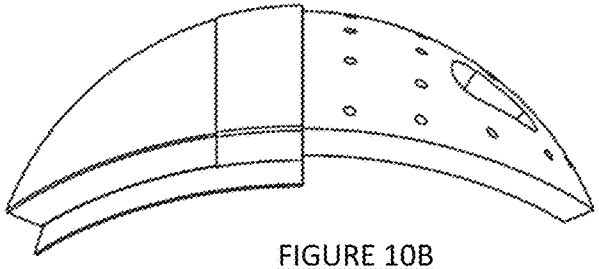
FIG. 10A through 10D depict various partially cut-away perspective views of one exemplary embodiment of an impact pad assembly.
Figure 10A:
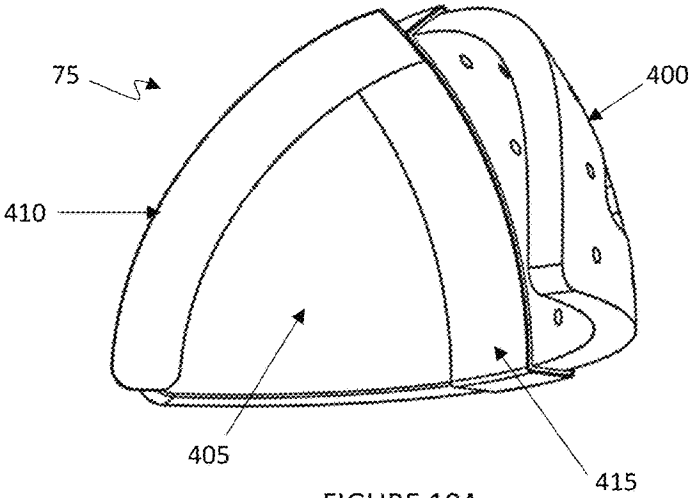
Figure 10C:
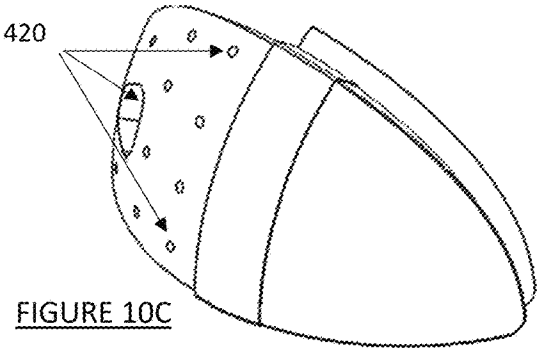
Figure 10D:
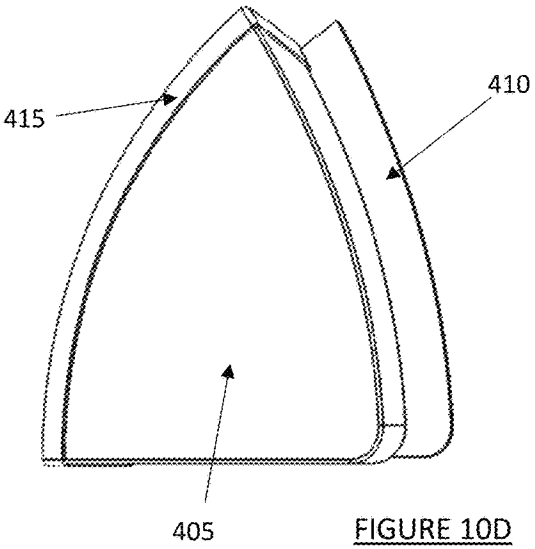
Figure 10I:
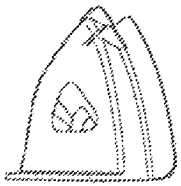
FIG. 10E through 10J depict various views of another exemplary embodiment of an impact pad assembly.
Figure 10H:
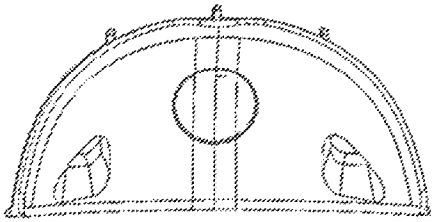
Figure 10G:
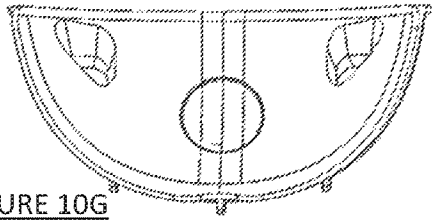
Figure 10E:
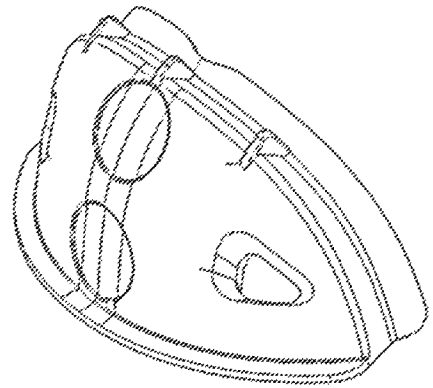
Figure 10J:
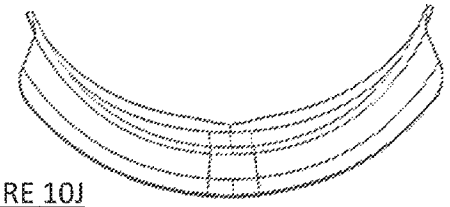
Figure 10F:
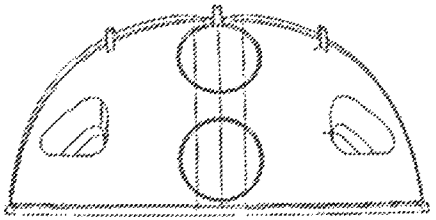

FIGS. 9A through 9E depict various views of one exemplary embodiment of a ridge pad assembly 70, which is desirably located within the helmet, at a position inside of the front/back strap 260 and the connecting straps 315 (i.e., located between the wearer's head and the straps). As best seen in FIG. 9B, the ridge pad assembly 70 comprises a central ridge plate 350 with a plurality of comfort pads disposed on a wearer-facing surface of the plate 350, which in this embodiment comprise a forward ridge pad 355, a central ridge pad 360 and a rearward ridge pad 365, each of which can be removably and/or permanently affixed to the plate 350. The central ridge pad 360 and the central ridge plate 350 each further include an opening 370 extending therethrough (see FIGS. 9D and 9E) to facilitate mounting mechanisms or features described herein. In use, various thicknesses of ridge pads could be utilized to raise and/or lower the helmet relative to the user's eyebrows to provide a desired level of visibility to the wearer, as well as for wearer comfort.

FIGS. 10A through 10D depict various partial cross-section view of one exemplary embodiment of an impact pad assembly 75, which is desirably positioned within the helmet at a location adjacent to the forehead of the wearer. The impact pad assembly 75 can comprise at least one curved or hemispherical piece of deformable foam 400 such as a polyurethane foam and/or memory foam (which may alternatively comprise a plurality of foam pieces, if desired), which is overlaid with a flexible, elastic and/or stretchable fabric and/or mesh fabric 405, and a ridge plate 410. Furthermore, the impact pad may have an increased surface area that conforms to the frontal bone of the wearer's skull. The impact pad may be mounted to the inner shell, the reflex layer, and/or the outer shell to stabilize the impact pad within the helmet. The front comfort pad assembly may desirably be mounted additionally with the impact pad for further comfort and/or impact protection. Such multi-layered design of the impact pad and/or the front assembly pad can improve impact absorption or dissipate forces by up to 10%. If desired, a ridge plate 410 and/or support straps 415 comprising a flexible plastic and/or other material(s) may be incorporated into the impact pad assembly 75 to provide a transition from the inner shell to the impact foam, as well as for additional positional stability and/or support. In the disclosed embodiment, the foam 400 also includes one or more openings or voids 420 formed therethrough, to desirably provide the wearer with additional comfort and/or allow perspiration on the wearer's skin to penetrate the foam layer. FIGS. 10E through 10J depict an alternative embodiment of an impact pad assembly.

FIGS. 11A through 11D depict various views of one exemplary embodiment of a jaw pad assembly 400, which is desirably located within the helmet at a position proximate to the mandible or cheek of the wearer. In this embodiment, the jaw pad assembly 400 comprises a jaw pad backing plate 405, a backing sheet 410 and a jaw comfort pad 410 disposed on a wearer-facing surface of the backing plate 405. The backing sheet can desirably include an adhesive or other material which removably and/or permanently secures the pad 410 to the plate 405. The backing plate 405 further includes a plurality of openings 415, which in various embodiments can include internally-facing threads that can engage with an external screw (not shown) for securing the jaw pad assembly 400 to the load shell 20. By utilizing an external screw to secure the jaw pad assembly to the helmet shell in this manner, the present design can facilitate removal of the jaw pad assembly from the helmet in emergency situations while the helmet is still being worn, which can in turn facilitate quick and easy removal of the helmet from the wearer in the event of an injury to the head, neck and/or back of the wearer.

Figure 11D:
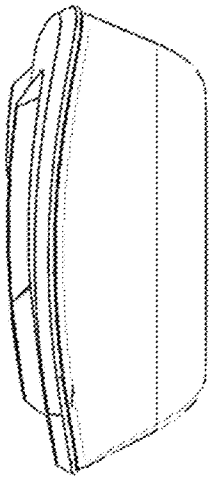
FIGS. 11A through 11D depict various views of one exemplary embodiment of a jaw pad assembly.
Figure 11C:
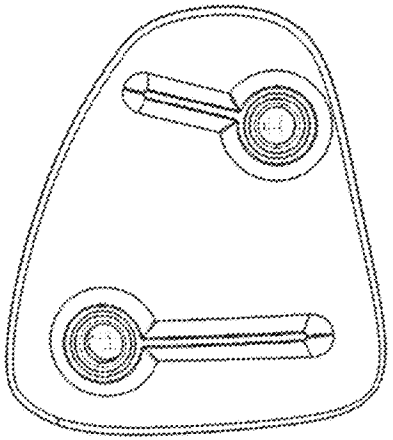
Figure 11B:
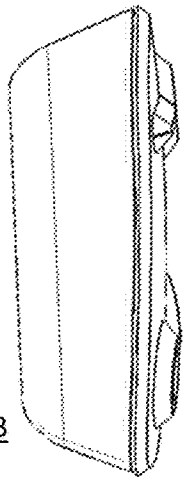
Figure 11E:
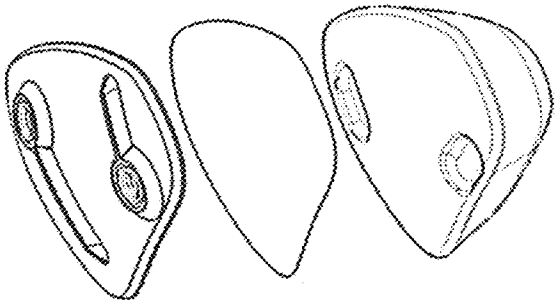
FIG. 11E depicts an exploded view of the jaw pad assembly of FIG. 11A.
Figure 11A:
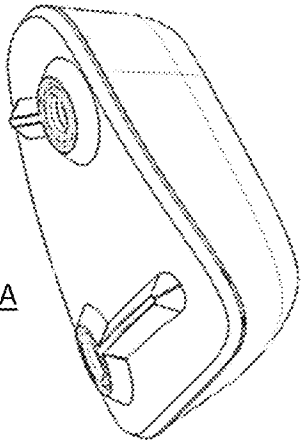

While a left-side jaw pad assembly is depicted in the embodiment depicted in FIG. 11A, it should be understood that the right-side jaw pad assembly can essentially be a mirror-image to accommodate placement in the right side of the helmet. It should also be understood that the left and right-side assemblies need not necessarily be mirror images of each other. In alternative embodiments, the left and right-side assemblies could be designed and/or configured differently, such as where one or more individual pads of each assembly could differ in thickness, shape and/or size, could be positioned in different locations on the assemblies, and/or where the thicknesses of individual pads on the left and right assemblies could differ relative to each other and/or to a corresponding pad on the opposing assembly.

Figure 16B:
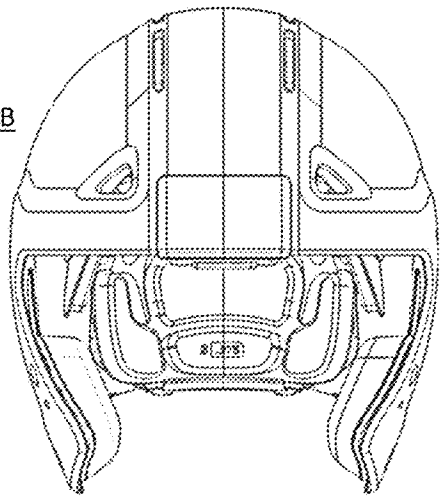
FIGS. 16A through 16C depict various views of an assembled inner modular impact liner system, with left and right jaw pad assemblies shown mounted to an outer helmet shell.
Figure 16C:
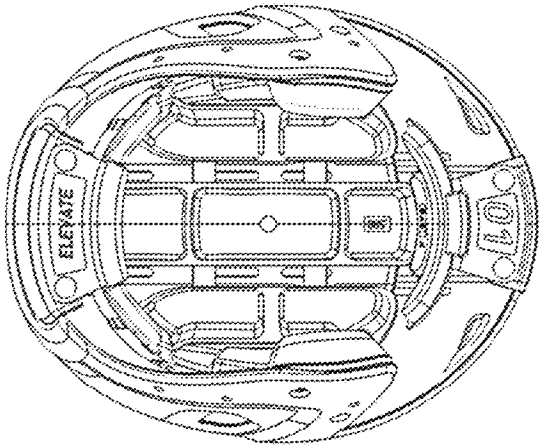
Figure 16A:
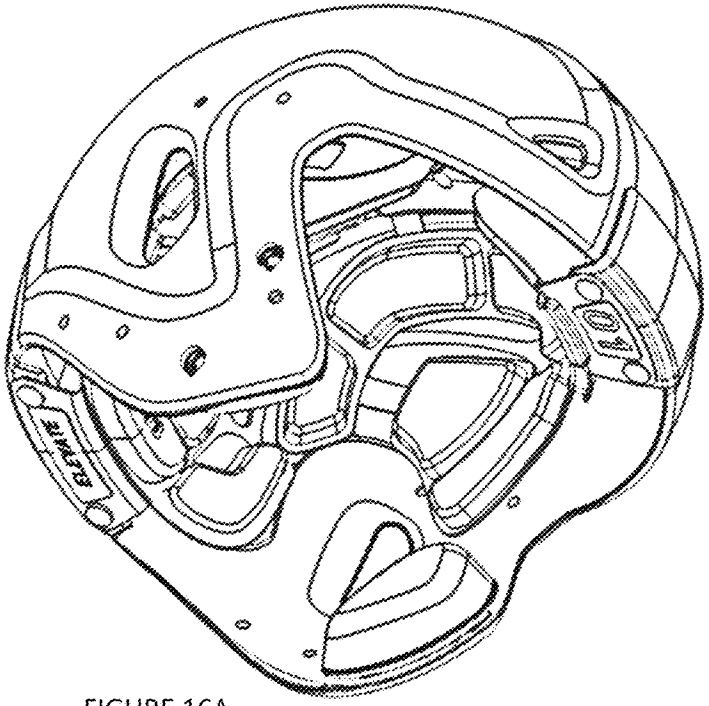

FIGS. 14A through 14E depict various views of one embodiment of an assembled inner modular impact liner system comprising a plurality of modular liner components, wherein the left and right jaw pad assemblies are not shown. FIGS. 15A through 15G depict various views of the assembled inner modular impact liner system mounted to an inner shell 40, with the left and right jaw pad assemblies shown. FIGS. 16A through 16C depict various views of the assembled inner modular impact liner system, with the left and right jaw pad assemblies shown mounted to an outer helmet shell 20.

Figure 17A:
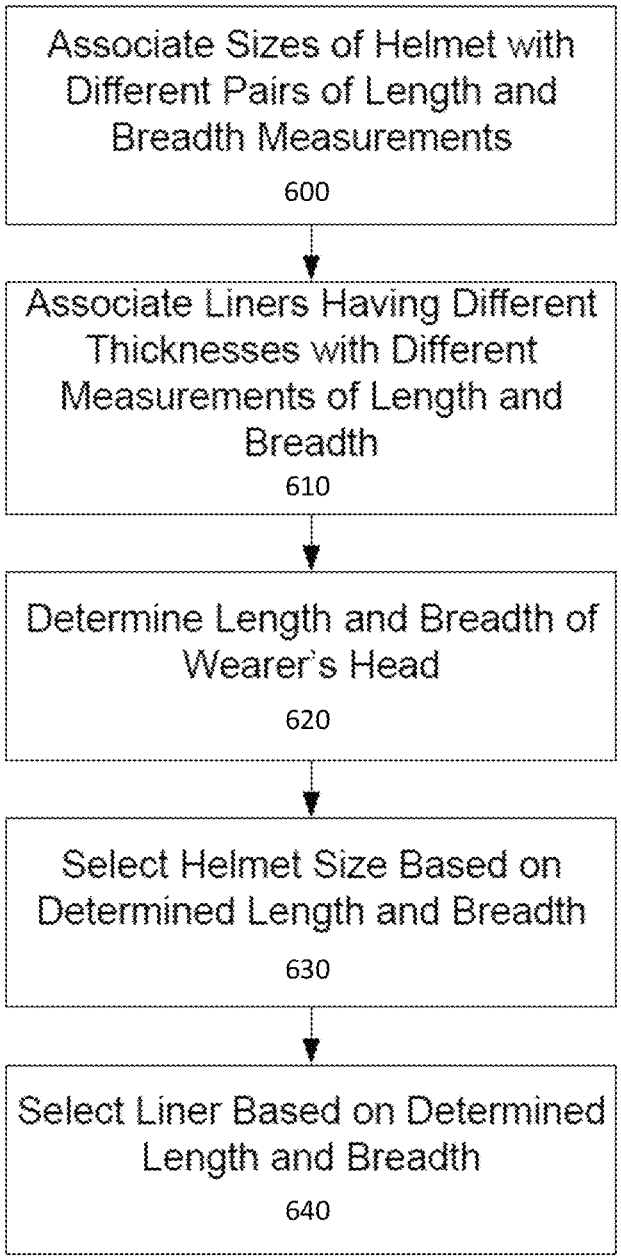
FIG. 17A depicts one exemplary embodiment of a flowchart describing a method for selecting a size of a helmet and associated components for a wearer.

FIG. 17A depicts one exemplary embodiment of a flowchart describing a method and procedure for measuring a wearer's anatomy and selecting and fitting a helmet and modular impact liner system to the wearer. In various alternative embodiments, the method may include different or additional steps than those described in conjunction with FIG. 14. Additionally, in some embodiments, the method may be performed in different orders than the order of the specific steps described in conjunction with FIG. 14.

Figure 17B:
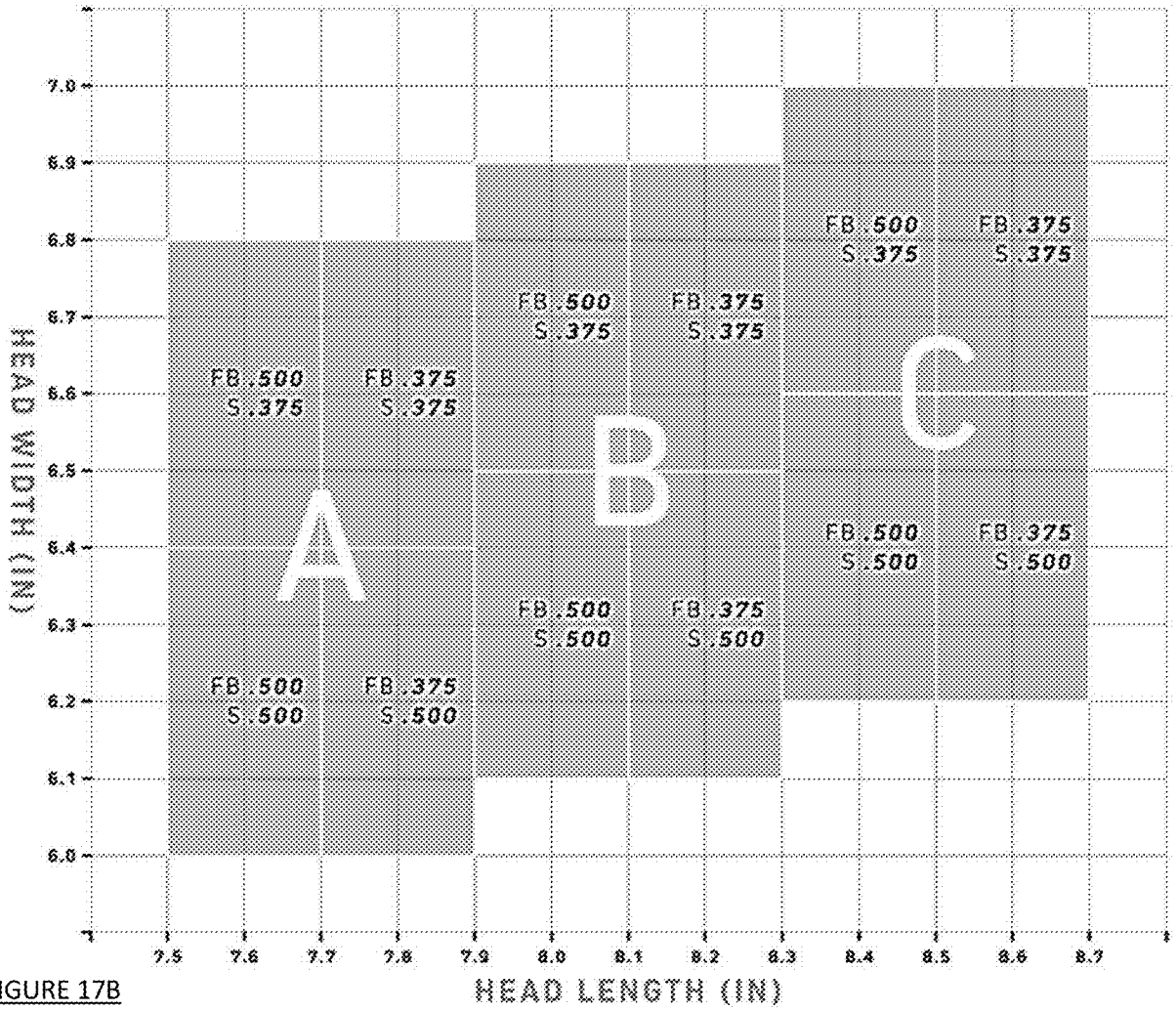
FIG. 17B depicts one exemplary embodiment of a sizing chart for selecting helmet components based on wearer measurements.

In an initial step of the procedure, different sizes of a helmet can be associated 600 with different pairs of length and breadth measurements for various head sizes. For example, a helmet system can include different shells having different sizes and/or shapes, and different shells could be associated 600 with different combinations of length measurements and breadth measurements of head sizes. As a specific example, a helmet may include one of three shells (A, B and C), each having different dimensions, so each shell is associated 600 with a range of length measurements of head size and breadth measurements of head size. In the preceding example, three ranges of length measurements and breadth measurements are maintained, with a different size shell associated 600 with each of the three ranges, which in various embodiments may or may not include a potential size overlap between ranges (i.e., one measured head size might be accommodated by two different sizes of helmet and/or insert combinations). FIG. 17B depicts one exemplary embodiment of a sizing chart for helmet components as described herein.

To particularize a helmet design to more securely fit a wearer's head, a plurality of different liners may be attached to an interior surface of the shell, so a surface of a liner attached to the interior surface of the shell can contact many portions of a wearer's head when the helmet is worn. An appropriate liner component can comprise a flexible layer with a deformable material, such as foam (e.g., low resilience open cell polyurethane foam), coupled to different regions of the flexible layer. In various embodiments, the deformable material can have at least a threshold recovery time, so the deformable material returns to its original shape after compression in at least the threshold recovery time. The deformable material can include one or more surfaces that contact the wearer's head when the helmet is worn. In various embodiments, the deformable material may be coupled to regions of the flexible layer so the deformable material uniformly distributes force around the wearer's head when force is applied to the helmet.

In various embodiments, different liner configurations could include modular components having different thicknesses, distributions and/or shapes of the deformable material(s), allowing a variety of different liner assemblies to be constructed and attached to an interior surface of a shell to maximize and/or optimize an amount of the helmet and/or liner in contact with a wearer's head. In some embodiments, liners having different thicknesses and configurations of the deformable material could also be associated 610 with different combinations of length and/or breadth measurements (see FIG. 17B). For example, different ranges of length measurements of head size and breadth measurements of head size could be accommodated, with liner components including different thicknesses of deformable material associated 610 with each range. In various alternative embodiments, a variety of measurements or other information taken of a wearer's anatomy could be utilized to associate, select and/or customize a helmet, liner and/or related components for a wearer, including measurements at deflection and/or angles other than anterior/posterior and/or medial/lateral, and/or circumferential, which could include (but are not limited to) measurements such as height (including height from a certain anthromorphic landmark to the top of the head) and/or other potential head topography information (including 2 or 3-dimensional scans of a portion or all of the wearer's head) which could include measurements gathered by contact techniques (i.e., physical contact) and/or non-contact means, including passive, visual and/or reflective scanning techniques, ultrasound, non-invasive imaging, photography, 2D/3D mapping, X-ray, CT-Scan, MRI, infrared measurements and/or other types of scanned data, which could be utilized alone and/or in combination with other methods that may allow differentiation between the skull and softer tissues such as the skin, fatty deposits and/or hair of the wearer.

Figure 17C:
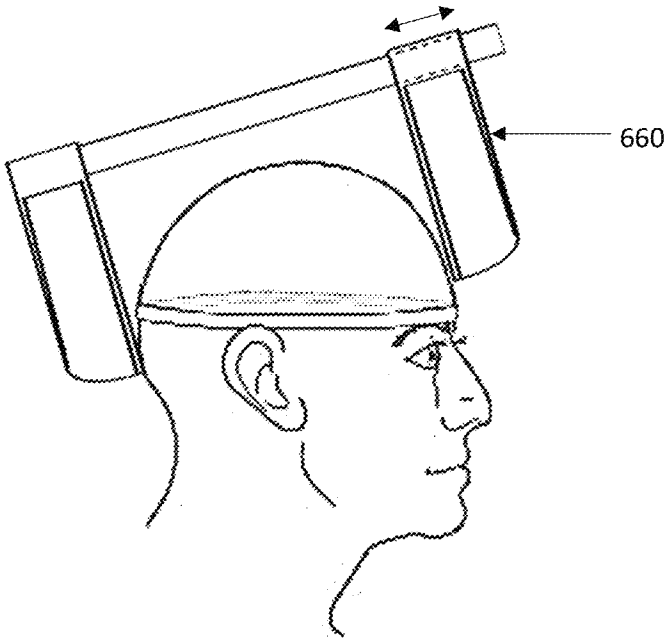
FIGS. 17C and 17D depict one exemplary embodiment of a measurement caliper and associated procedure for taking measurements of a wearer's head.
Figure 17D:
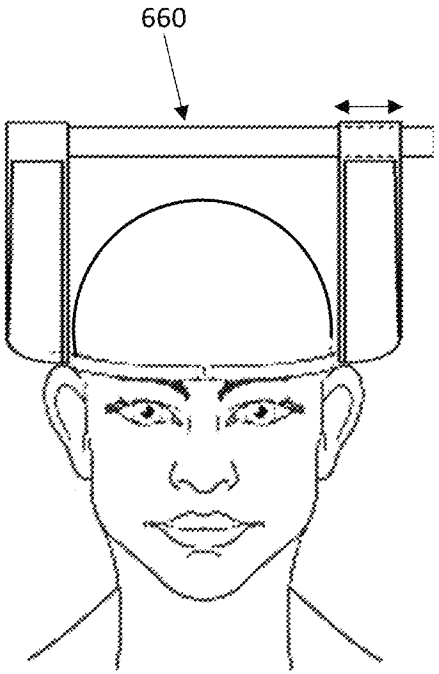

When sizing a helmet for a wearer's head using various of the techniques described herein, a length and a breadth of the wearer's head can be determined 620. FIGS. 17C and 17D depict one exemplary embodiment of a measurement caliper 660 that can be utilized to take measurements of the wearer's head using the described methods and procedures. In this embodiment, the wearer's anterior/posterior head length can first be measured (see FIG. 17C), with one arm of the caliper 660 placed slightly above the eyebrows of the wearer, and the other arm of the caliper 660 on the back of the head. In many cases, the calipers will desirably be tilted slightly back, with the rearward caliper above, adjacent to and/or in proximity to an occipital region of the wearer's head, and the forward caliper in light contact with the wearer's forehead. Measurements can be read from a gage on the caliper, wherein in some embodiments this measurement can be rounded up if falling between increments on the caliper. The wearer's medial/lateral width of the head can then be measured (see FIG. 17D), with the arms of the calipers placed above each ear. Desirably, the caliper arms will lightly touch the sides of the head, without any significant pressure on the wearer's skin. Measurements can be read from a gage on the caliper, wherein in some embodiments this measurement can be rounded up if falling between increments on the caliper. Where the wearer may have significant or thicker hair, a measurement may be taken by pressing the caliper plates against the hair until the hair "pushes back" or creates a slight resistance to the caliper plate, at which point the measurement can be recorded.

Based on the determined length and breadth of the wearer's head, a helmet size can be selected 630 (i.e., helmet component size A, B or C in FIG. 17B). For example, a helmet shell associated 600 with a range of length measurements and breadth measurements that accommodate the determined length and breadth of the wearer's head can be selected. By selecting 630 the size of the helmet based on the determined length and determined breadth of the wearer's head, a fit of the helmet for the wearer's head can be greatly improved as compared to more conventional methods of shell selection that determine a shell based on only a circumference measurement of the wearer's head.

Once the helmet shell has been selected, the measured length and breadth of the wearer's head can be utilized to select one or more liner components 640 for assembly into a modular liner assembly and attachment to the interior surface of the previously selected shell. For example, a liner associated 600 with a range of length measurements and breadth measurements, sized and configured to accommodate the determined length and breadth of the wearer's head, can be selected 640 (i.e., a 6.6" width and 7.6" length of the wearer's head corresponds to liner components FB=0.500 and S=0.375 in Helmet Component "A" of FIG. 17B). In this way, the helmet size, associated helmet components and the liner assembly ultimately attached to an interior of the helmet can be selected based on the determined length and breadth of the wearer's head, allowing the helmet to be more accurately sized for different sized and/or shaped skulls.

In various embodiments, if a measurement intersection lands on a line between helmet models (see FIG. 17B), it may be advantageous to select the larger of the two models for further fitting procedures, leaving the smaller model available for fitting if the larger model fit is unsuccessful. Similarly, if a measurement intersection lands on a line between liner combinations, it may be advantageous to select both liners at 0.375 and then adjust the fit with different sized liner components.

Figure 18:
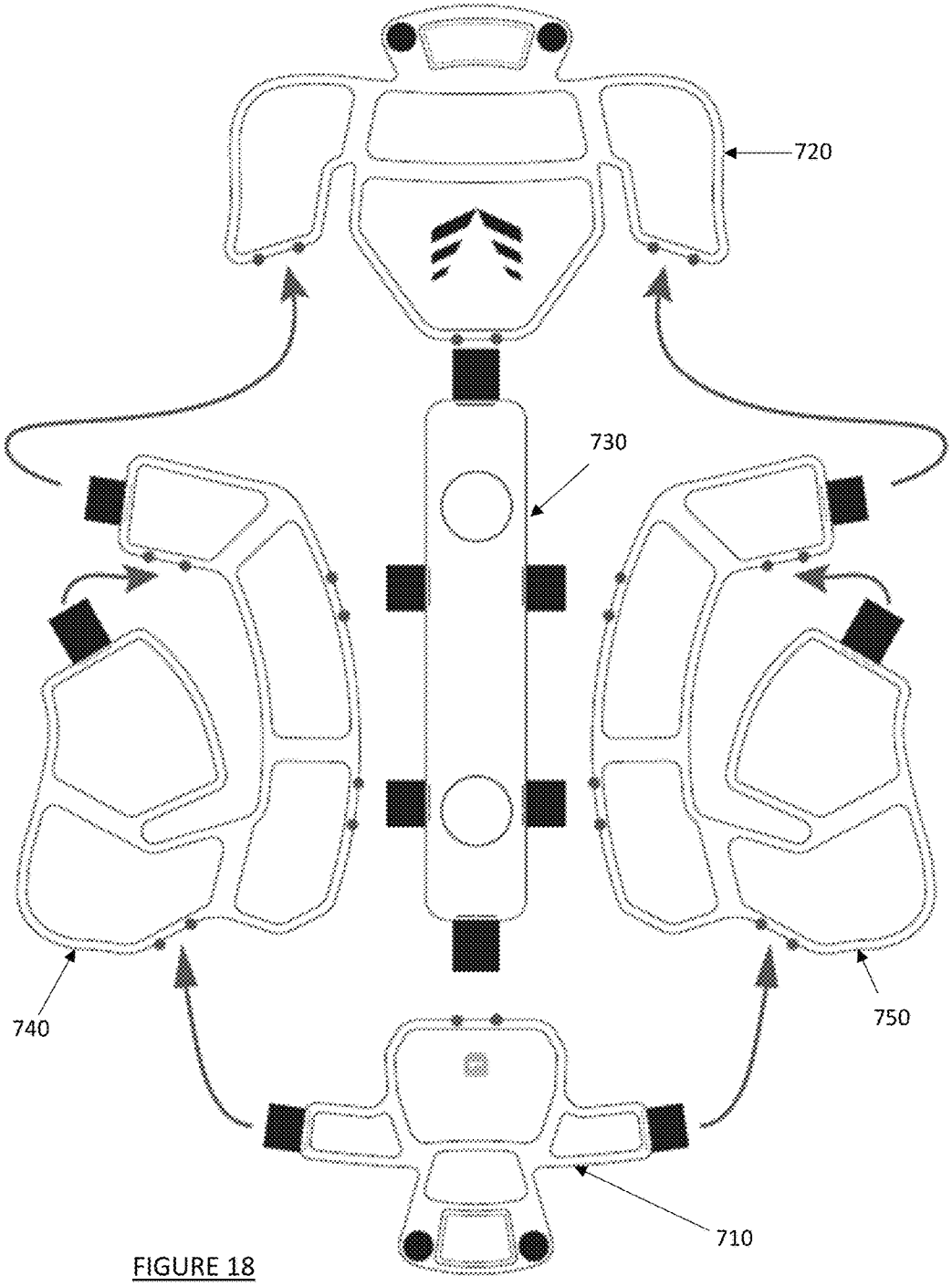
FIG. 18 depicts a front view of another exemplary embodiment of a modular liner system.

In one embodiment, where a modular liner system is used, selecting a liner for a wearer comprises selecting sizes for each liner segment of the modular liner system. As illustrated in FIG. 18, the liner segments may include a front pad 710, a back pad 720, a midline base pad 730, and two side pads 740 and 750. Selecting a liner for a wearer's head can comprise selecting sizes (e.g., thicknesses and/or other feature variations) for each of these liner segments. This process may include a variety of sizes that may be selected from a set of templates, wherein map measurements taken from a wearer's head can be compared and/or graphed to an initial selection of sizes for the liner segments. A fitter may then adjust the initial selection of liner segment sizes by fitting the liner segments into a helmet, putting the helmet on the wearer, asking for feedback, modifying one or more of the liner segment sizes, and repeating this process until the wearer is satisfied with the helmet's fit.

In various embodiments, a deformable material coupled to one or more regions of the individual selected modular liner component may be replaced and/or substituted with other types of alternative deformable materials, which could allow different regions of the selected liner component to incorporate different thicknesses, shapes and/or distributions of the deformable material or different material properties. Modifying the thickness, distribution, composition and/or other properties of the deformable material in different regions of the selected liner could allow additional customization of the sizing and/or performance of the helmet for a particular wearer, desirably also improving fit and comfort of the helmet for the wearer as well as potentially improving helmet safety and protection. For example, a set of thicknesses of the deformable material could be provided for different regions of a liner, allowing selection of a thickness from the set of varying thicknesses to couple to a region of the flexible layer of the liner. In some embodiments, different sets of thicknesses of the deformable material could be associated with different regions of the liner. For example, three sets of thicknesses of the deformable material could be associated with a given region and/or modular liner component, which could then be coupled to an upper portion of the interior surface of the shell, while three different sets of thicknesses could be associated with another region of the liner coupled to a side portion of the interior surface of the shell. In some embodiments, different thicknesses could also be associated with regions of the liner coupled to a front portion and/or a rear portion of the interior surface of the shell. Alternatively, thickness of the deformable region for each region of the layer could be selected from among a set of thicknesses common to each region. Deformable material coupled to regions of the liner may be modified with alternative deformable material to modify characteristics other than thickness in some embodiments. For example, deformable material coupled to regions of the liner may be replaced with alternative deformable material having a different stiffness than the deformable material. As an example, the deformable material may become stiffer in colder temperature and less stiff in warmer temperatures, so deformable material coupled to different regions of the liner may be replaced with alternative deformable material having different characteristics to offset changes in stiffness caused by temperature.

In another embodiment, different sizes of helmet shells could be associated with different combinations of length measurements and breadth measurements of head size, where a helmet shell has an interior surface determined by a combination of a length measurement and a breadth measurement of head size. A set of liner types could be configured to be inserted into the interior surface of the helmet shell. Each liner type could comprise a plurality of sections of deformable material coupled to different regions of a flexible layer. For example, a liner type having thicker sections of deformable material coupled to regions on sides of the flexible layer relative to thicknesses of deformable material coupled to regions on a front or a rear of the flexible layer. As another example, another liner type could have thicker sections of deformable material coupled to regions on a front or a rear of the flexible layer relative to thicknesses of deformable material coupled to regions on sides of the flexible layer.

In various embodiments, a method of sizing a helmet or other head protector for a wearer could comprise measuring a length and a breadth of the wearer's head, and then comparing the measurements to a list, chart and/or other reference to determine an appropriate helmet shell and/or other helmet accessories (i.e., an inner shell and/or reflex layer components) selected based on the combination of the length and the breadth of the wearer's head. Additionally, a liner type could be selected from the set of liner types based on the length and breadth of the wearer's head, such that inserting the selected liner type into the interior surface of the determined helmet shell provides the wearer with a close fit that uniformly distributes pressure around the wearer's head (or provides other pressure distributions) in a desired manner. If a smaller liner type is required to fit into a larger shell size, the flexible layer(s) of the liner type could possibly be stretched to increase spacing between the sections of deformable material less than a threshold amount, which provides a similar fit as when the flexible layer of the liner type is not stretched. Using different helmet shells and a set of liner types from which a helmet shell and a liner type is determined from a length and a breadth of a wearer's head allows close fitting of a helmet to a wide range of head shapes and sizes without a significant number of different liner types and helmet shell sizes.

Optimizing Occipital Pad Features

In various embodiments, a modular liner assembly of a protective helmet could optionally include a liner element that provides an occipital contact region with the wearer's head, which desirably increases a surface area of the liner contacting the wearer's head while further desirably reducing movement of the wearer's head between a front surface of the helmet and a rear surface of the helmet. An occipital contact region may be coupled to a liner of a helmet (or other helmet component) using a variety of mechanisms.

Figure 19A:
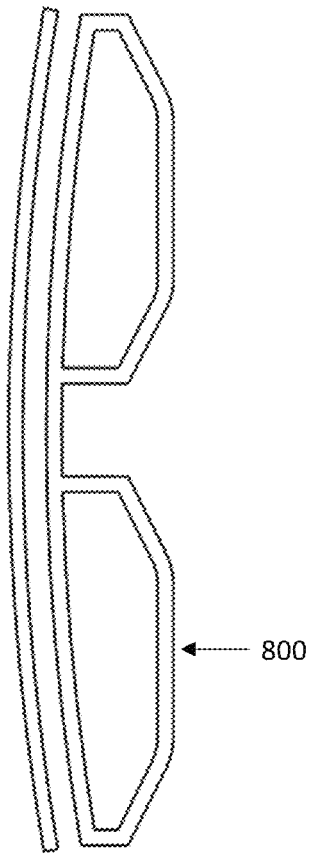
FIG. 19A depicts a diagram of one exemplary embodiment of an occipital contact region and liner region attached to an interior surface of a helmet shell.

FIG. 19A shows an exemplary occipital contact region 800 included in a modular liner component. In the example of FIG. 19A, the occipital contact region 800 can comprise a deformable material coupled to a region of the liner's flexible material that is in turn coupled to a portion of a helmet shell positioned proximate to a rear of a wearer's head. If desired, the occipital contact region could comprise a piece of the deformable material separate from pieces of deformable material coupled to other regions of the flexible layer of the liner. In other alternative embodiments, the occipital contact region may be a continuation of the deformable material having the same or a different profile than profiles of the deformable material(s) coupled to other regions of the flexible layer of the liner.

Figure 12B:
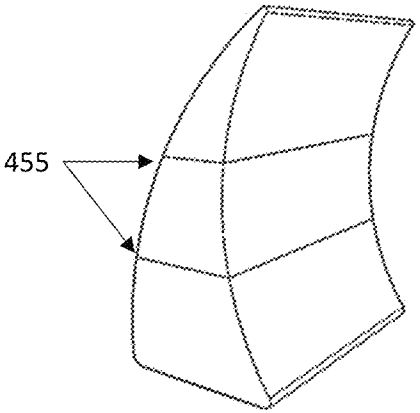
FIGS. 12A through 12D depict various views of one exemplary embodiment of an occipital contact element.
Figure 12D:
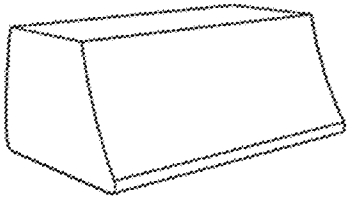
Figure 12C:
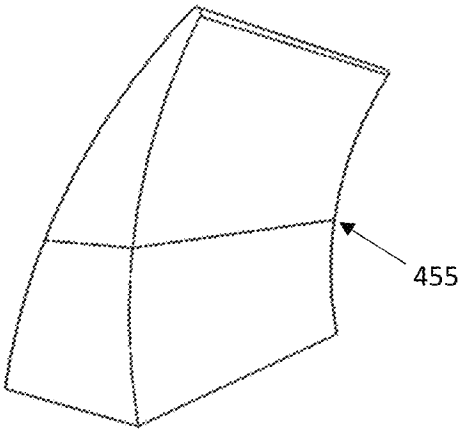
Figure 12A:
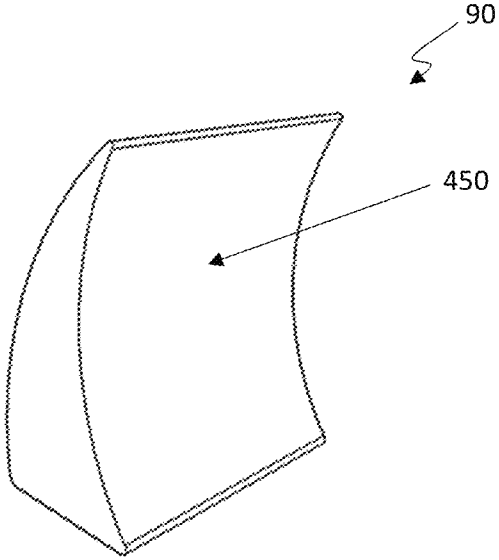

In various embodiments, an occipital contact region can have a wedge or other shape (see FIGS. 12A through 12D, 13A, 13B and 19A through 21B). FIG. 12A depicts an optional wedge pad assembly 90 that can be utilized with the disclosed helmet and liner assembly. In this embodiment, a curved, triangular and/or wedge-shaped piece of memory foam 450 or similar material can be provided that allows a portion of the previously described assemblies (i.e., the right/left liner assembly, a front/back liner assembly, ridge pad assembly and/or impact pad assembly) or other liner components to be raised, lifted, tilted and/or otherwise displaced to accommodate one or more unique anatomical features of the wearer and/or to provide the wearer with a more secure and/or comfortable fit. If desired, the assembly 90 can comprise multiple pieces of foam (see FIGS. 12B and 12C), with various score lines 455 provided that can facilitate separation and/or tearing of individual pieces of the assembly (see FIGS. 12C and 12D) for use in a desired manner.

In various exemplary embodiments, a wedge pad assembly 90 can comprise an occipital wedge pad assembly (see FIG. 12A) that can be utilized to alter the position, orientation and/or alignment of one or more pads of the back-pad assembly 100 in a desired manner to better fit an occipital region of the wearer's skull.

Figure 13B:
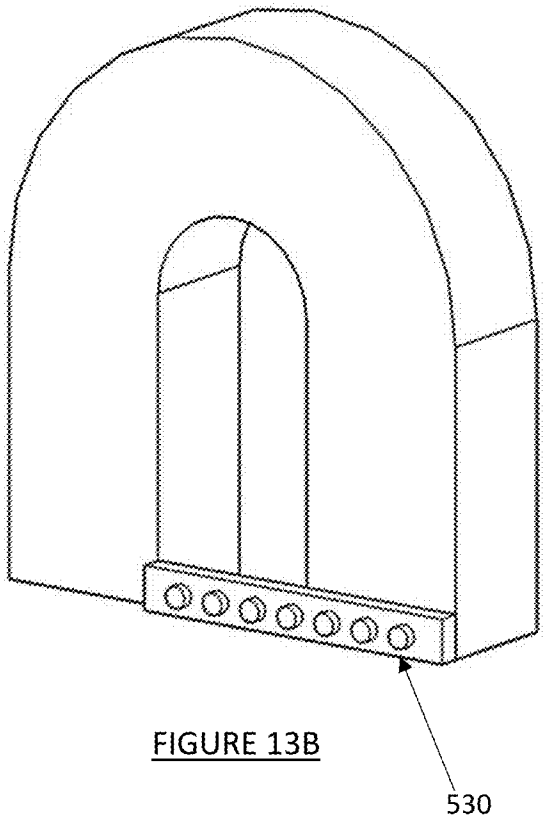
FIG. 13B depicts another exemplary embodiment of an occipital contact element.
Figure 13A:
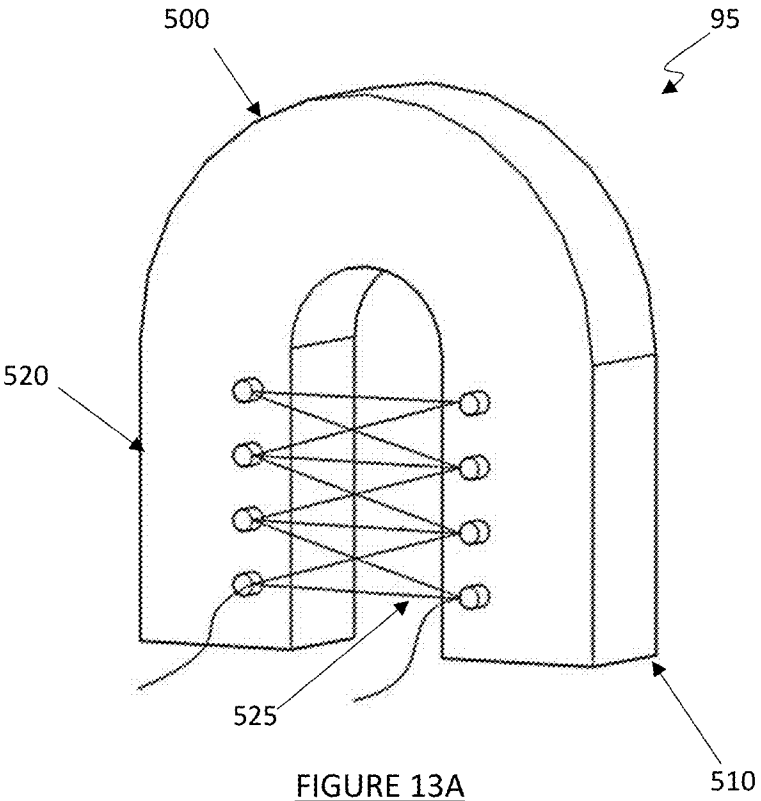
FIG. 13A depicts another exemplary embodiment of an occipital contact element
Figure 14C:
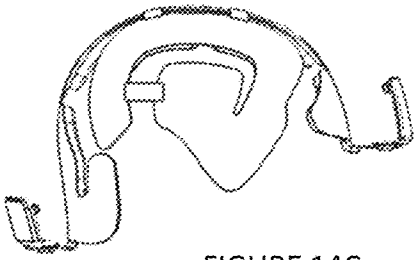
FIGS. 14A through 14E depict various views of one exemplary embodiment of an assembled inner modular impact liner system, without showing left and right jaw pad assemblies.
Figure 14E:
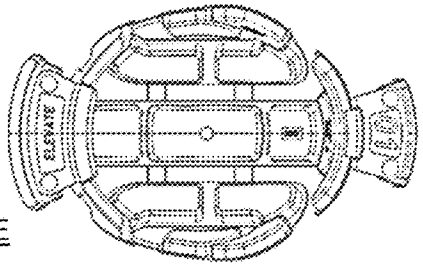
Figure 14A:
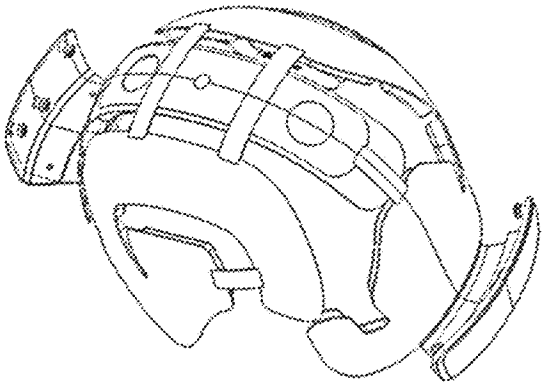
Figure 14D:
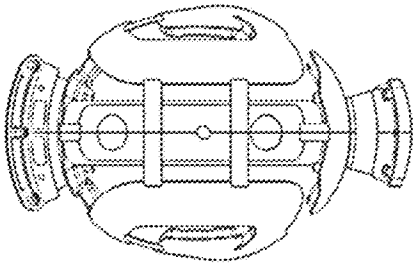
Figure 14B:
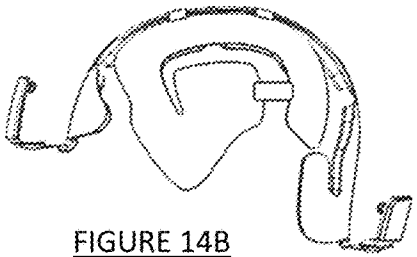
Figure 15D:
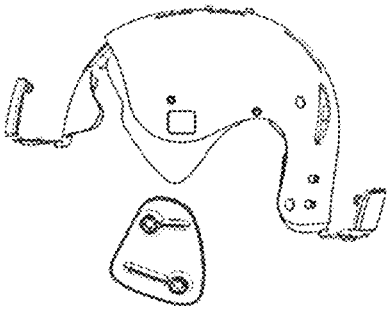
FIGS. 15A through 15G depict various views of a fully assembled inner modular impact liner system mounted to an inner shell, with left and right jaw pad assemblies shown.
Figure 15E:
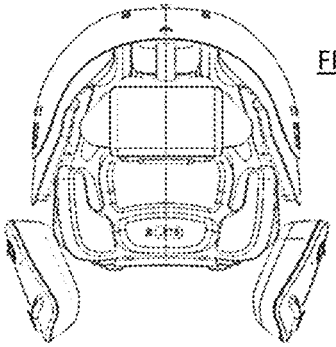
Figure 15C:
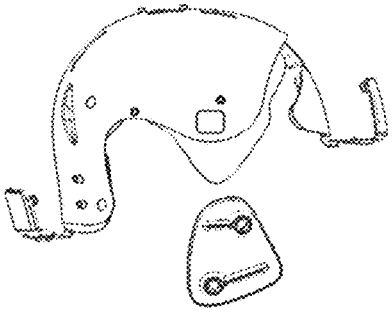
Figure 15A:
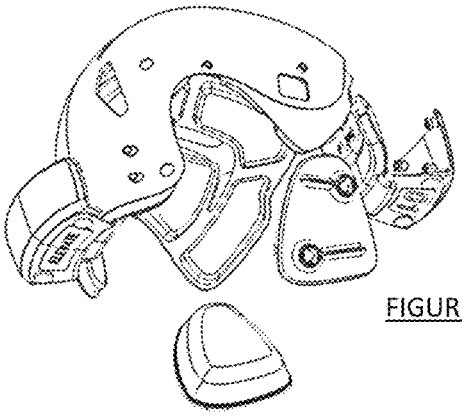
Figure 15B:
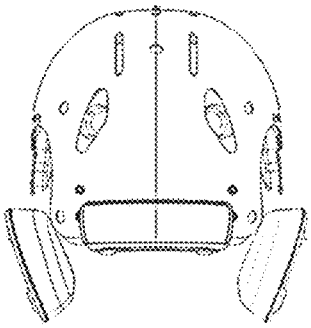
Figure 15F:
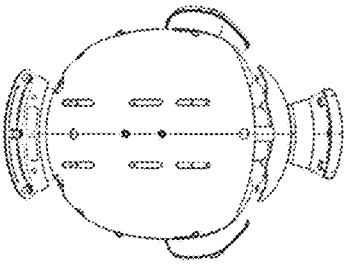
Figure 15G:
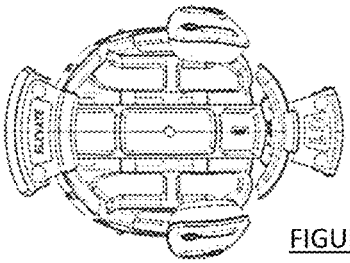

FIG. 13A depicts one exemplary embodiment of an occipital contact element which can be positioned proximate to a rear of a wearer's head, with the element including one or more adjustable laces. In this embodiment, an optional corset pad assembly 95 can comprise a U-shaped piece of memory foam 500 or similar material can be provided that allows adjustment of a spacing between the legs 510 and 520 of the "U" in a desired manner. As depicted in FIG. 13A, a string or tether 525 can be attached to various locations of the foam 500, with tension of the tether 525 being increased and/or decreased to move the legs 510 and 520 closer together and/or further apart. Tightening the laces while the occipital contact region is contacting an interior surface of a region of the liner positioned proximate to a rear of a wearer's head will desirably secure the liner proximate to and/or around the occipital contact region of the wearer. In use, the corset pad could be positioned between the liner and an occipital region of the wearer's skull, with the tension of the tether adjusted to alter separation and/or positioning of the legs 510, 520, thereby accommodating one or more unique anatomical features of the wearer and/or to providing the wearer with a more secure and/or comfortable fit.

FIG. 13B depicts an alternative embodiment of a corset pad assembly, wherein an adjustable belt or snapback fastener 530 can be coupled to a liner component. Adjustment of the snapback fastener 530 can tighten or loosen the liner component's contact with a wearer's head. For example, adjusting the snapback fastener 530 to tighten the liner secures the occipital contact region between the liner and the wearer's head, while loosening the snapback fastener 530 can loosen the liner, allowing adjustment and/or removal of the occipital contact region from between the liner and the wearer's head. In other alternative embodiments, other shapes could be incorporated into the corset pad assembly, including "V," "W," "S" or "M" shaped foam pieces, as well as circular, square, triangular and/or oval foam pieces in various configurations, if desired.

Additionally, the occipital contact region could have one or more or a variety of different angles relative to the shell and/or to the wearer's head. In a similar manner, the occipital contact region could be formed from deformable materials that are different from the deformable materials forming and/or coupled to the liner. If desired, the occipital contact region could have a thickness or thicknesses in one or more portions that differ from thicknesses of other deformable material coupled to the liner.

In another exemplary embodiment, the occipital contact region could comprise a bladder or other structure incorporated into the liner and/or in contact with a portion of the liner's flexible material that is coupled to a portion of a helmet shell positioned proximate to a rear of a wearer's head. When the bladder is inflated with air or another fluid while a wearer is wearing the helmet, the occipital contact region could contact a rear portion of the wearer's head, which desirably increases a surface area of the liner contacting the wearer's head.

Figure 19B:
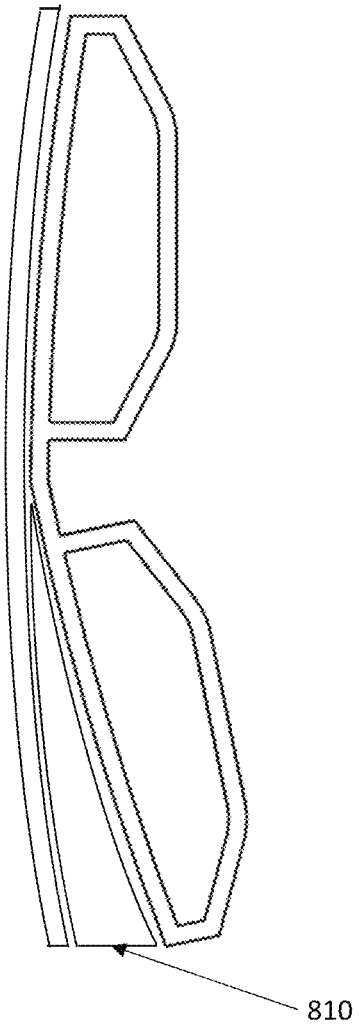
FIG. 19B depicts a diagram of an alternative exemplary embodiment of an occipital contact region and liner region attached to an interior surface of a helmet shell.

FIG. 19B depicts one alternative embodiment wherein an insert 810 can be positioned between an interior surface of the shell of the helmet and a surface of the liner. The insert 810 desirably reorients a portion of a pad or other deformable material coupled to a region of the liner positioned proximate to a rear of a wearer's head, thereby increasing contact between the portion of the deformable material and the rear of the wearer's head.

As previously noted, FIG. 12B shows one alternative embodiment of an occipital contact region where different sections formed from a deformable material can be coupled together and/or separated. Altering the number of sections of the deformable material by adding and/or fracturing one or more sections along the score lines 455 can allow for customization of one or more dimensions of the occipital contact region. For example, a lower section may be removed from the occipital contact region (see FIG. 12D) to reduce a length of the occipital contact region (see FIG. 12C). In various embodiments, any suitable mechanism may be used to releasably couple different sections of the deformable material to each other, including frangible linkages and/or hook and loop-type fasteners.

Figure 20:
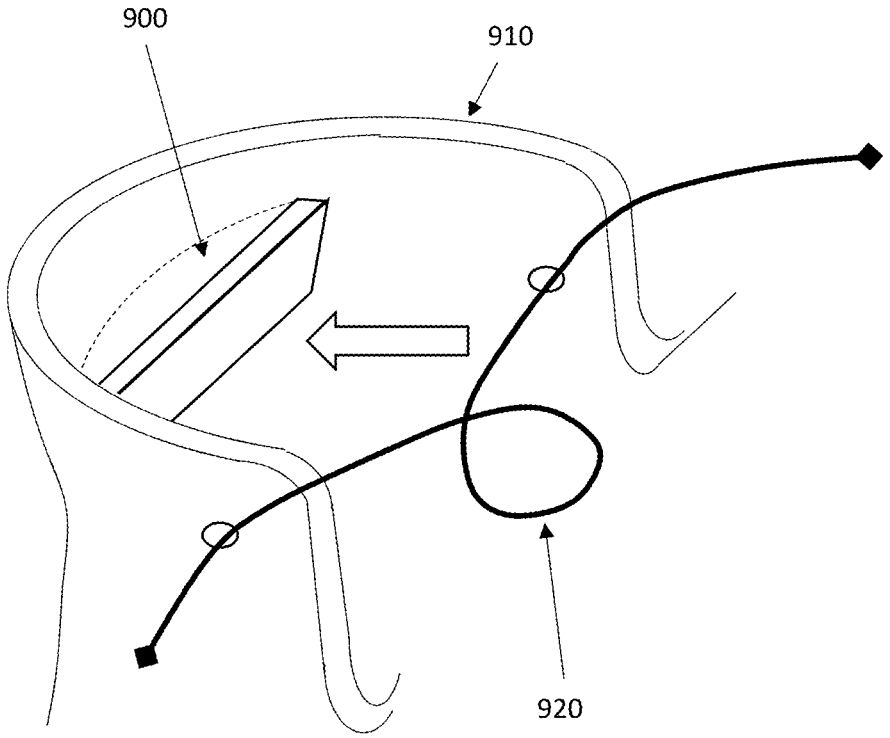
FIG. 20 is a diagram of an alternative exemplary embodiment of an elastic band included in a liner to secure an occipital contact region to the liner.

FIG. 20 shows another alternative configuration for securing and adjusting an occipital contact region relative to a head of a wearer. In this embodiment, an elastic band 900 can be included in a liner component 910, which is positioned such that the elastic band 900 traverses a circumference of the shell of the helmet (not shown) when the liner 910 is attached to the shell. An adjustment mechanism can be coupled to the elastic band 900 and configured to increase or to decrease tension of the elastic band 900 in a desired manner when adjusted. As depicted, the adjustment mechanism could be a drawstring 920 or similar feature that increases tension of the elastic band 900 when the drawstring is tightened and decreases tension of the elastic band 900 with the drawstring 920 is loosened. Hence, when the drawstring is 920 tightened and secured, tension of the elastic band 900 is increased, securing the occipital contact region to the liner 910. Similarly, if the drawstring 920 is loosened, tension of the elastic band 900 could be decreased, allowing the occipital contact region to be repositioned or removed from the liner 910.

Figure 21A:
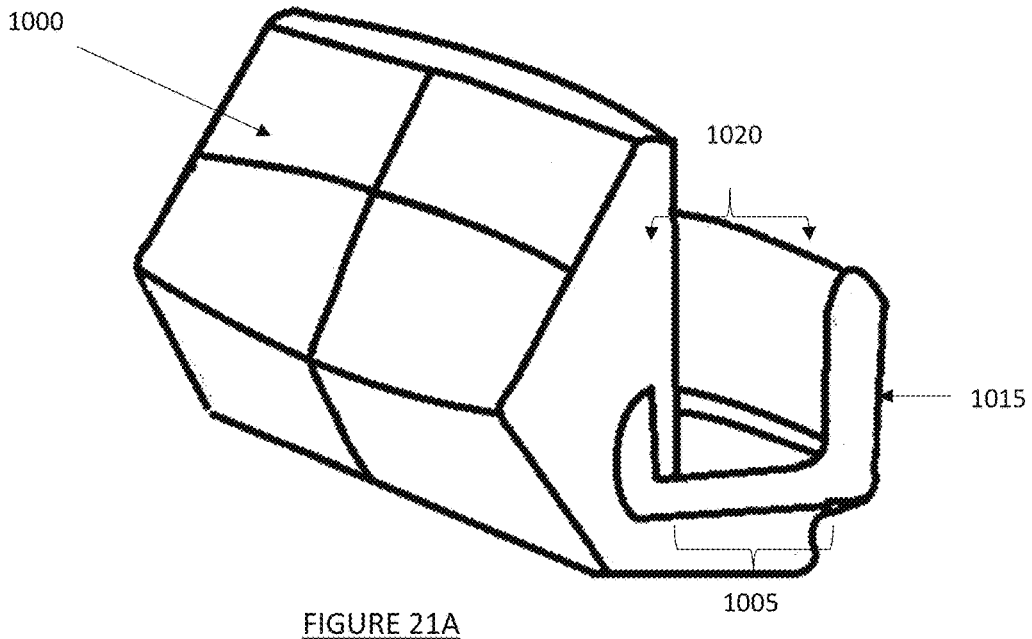
FIGS. 21A and 21B depict an alternative embodiment of an occipital contact element coupled to a bumper for securing to an outer shell region of a helmet.
Figure 21B:
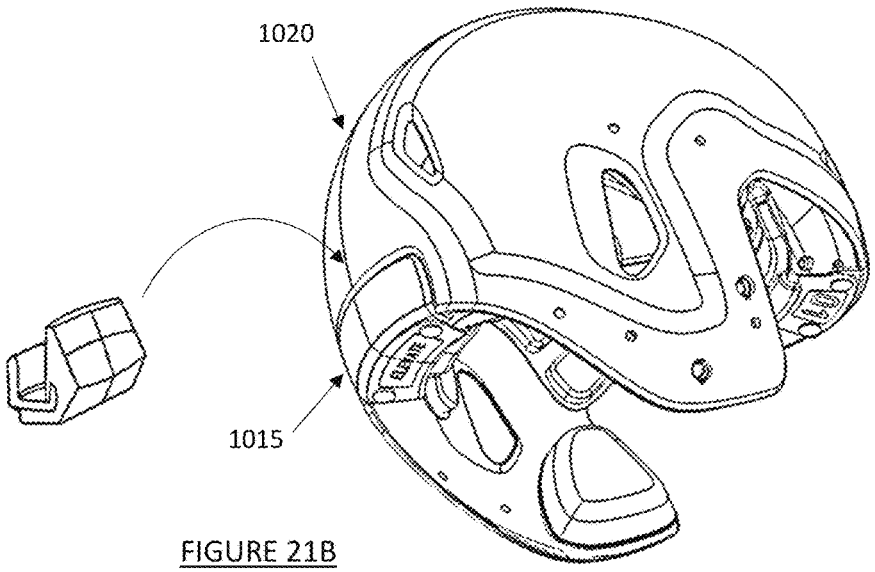

FIG. 21A shows an occipital contact region 1000 coupled to a bumper 1005. The bumper 1005 can be configured to attach to a rear surface of the shell, to another helmet component and/or to another portion of the liner (which in turn can be attached to the shell or other helmet component). For example, the bumper 1005 can include a central region 1010 configured to include and/or encompass a portion of a shell 1020, with a raised portion 1015 extending vertically from a rear surface of the bumper 1005. When the portion of the shell 1020 is inserted into the central region 1010, the raised portion 1015 desirably extends vertically along a surface of the shell 1020 to secure the bumper 1005 to the shell 1020 (see FIG. 21B). A front surface of the bumper 1005 can be coupled to the occipital contact region 1000, so the front surface of the bumper extends to an interior of the shell 1020 when the portion of the shell 1020 is inserted into the central region of the bumper 1005, so the occipital contact region 1000 is positioned in an interior of the shell 1020 and is capable of contacting a wearer's head. In various embodiments, different bumpers 1005 having different angles of the front surface relative to a plane including the central region 1010 may be provided, one or more of which may be coupled to the occipital contact region 1000 to alter an angle with which the occipital contact region 1000 enters the interior of the shell 1020.

FIG. 18 illustrates another exemplary embodiment a modular liner component system, in accordance with various embodiments of the invention. As illustrated, this system includes a plurality of separate liner segments, which includes a front pad 710, a back pad 720, a midline base pad 730, and two side pads 740 and 750. By utilizing separate liner segments that can be combined in various fashions, the modular liner component system can be customized to accommodate different shapes, sizes and/or anatomical structures at different areas of a wearer's head without requiring the custom manufacture of a single piece liner for every desired combination of thicknesses, while still providing a large number of sizing options to help achieve a good fit.

In the disclosed embodiment, each segment of the modular liner component system can comprise one or more padded regions, some or all of which can be connected by a flexible material, such as a fabric. The flexible material desirably allows the liner segments to be constructed on a flat surface and then bent or otherwise manipulated to be fitted inside a curved inner shell of a helmet. FIG. 18 illustrates one exemplary "cutout pattern" that would allow the liner padding to be constructed in a planar fashion, and then bent to conform to the inside of a generally round helmet for a secure fit to a head. Some of the liner segments, such as the back pad and front pad, may incorporate a variety of flat or other shaped areas where a logo, name, player number and/or other marking may be installed into the helmet. These markings may be removable (e.g., using Velcro) or permanent (e.g., by embroidery).

By utilizing flexible and/or stretchable connections between the various liner components and/or elements thereof, the present system greatly reduces the number of modular components necessary for accommodating a wide range of head sizes. This is because many of the liner components can be used in multiple helmet shell sizes, with the liner segments "stretched" to accommodate larger shell sizes, and the same liner segments "relaxed" and/or slightly compressed at the flexible connections to fit within the smaller helmet shell sizes. One exemplary arrangement of such components is shown in the chart of FIG. 17B, in which a wide variety of head sizes and/or shapes can be accommodated using a small number of flexible or adjustable liner components.

In various embodiments, attachment of the liner segments to an inner shell of a helmet can be accomplished using mating surfaces on the various liner components. For example, various surfaces of the liner and/or helmet may include hook and loop-type fasteners. Alternatively, snap-fits, detents and/or other helmet attachment mechanisms known in the art may be utilized.

Figure 22A:
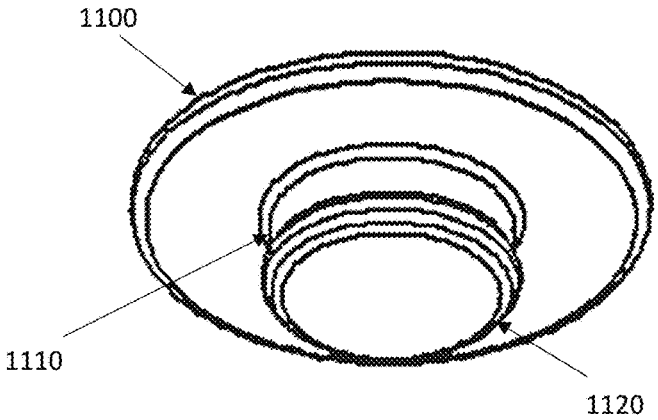
FIGS. 22A through 22C depict various views of one exemplary embodiment of an attachment post.
Figure 22B:
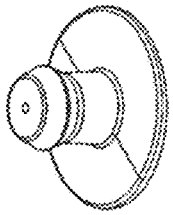
Figure 22C:
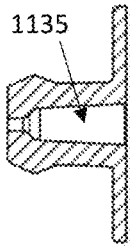
Figure 22D:
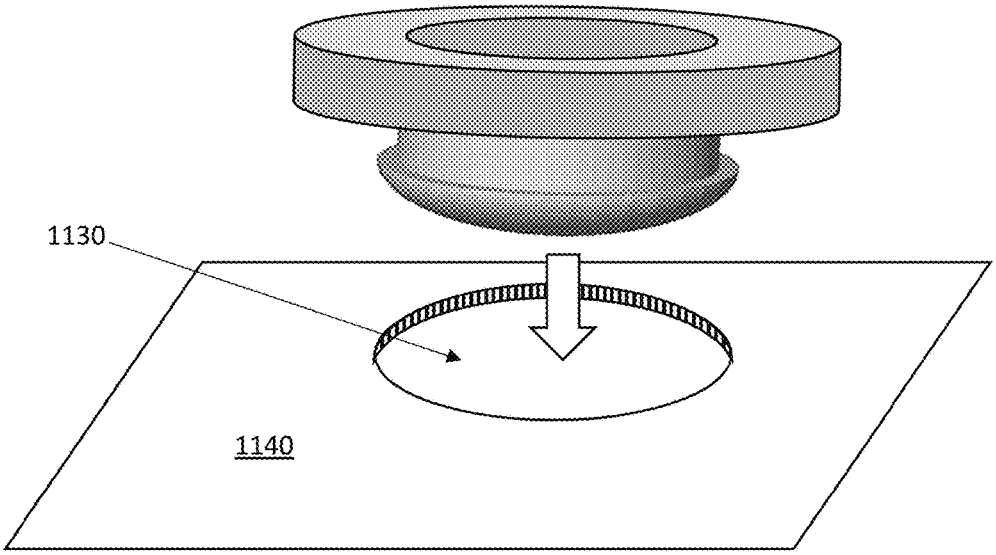
FIG. 22D illustrates the post of FIG. 22*a* being inserted into an inner shell of a helmet.

If desired, a surface of the liner segments opposite the padded regions may include one or more attachment mechanisms that can be configured to mate with the inner shell of the helmet. FIGS. 22A through 22D depict one exemplary attachment mechanism, including an attachment post 1100 that comprises an extension 1110 with a head 1120 having an increased diameter, where the head 1120 is designed to snap and secure into a corresponding hole 1130 in the inner and/or outer shell of a helmet 1140. FIG. 22C depicts a cross-sectional view of the post 1100, showing a hollow interior 1135 that can be formed inside of the extension 1110, if desired. FIG. 22D illustrates how the attachment post can be installed into a hole in the inner and/or outer shell of a helmet or other component.

In one embodiment, a plurality of attachment posts may be fixed to the liner segment components using an adhesive, or they can be mechanically attached and/or integrally formed during a molding process, etc. A tooling mechanism may be used to align the attachment posts properly for each liner. The tooling mechanism may comprise a flat board with holes corresponding to the desired positions of the attachment posts for each liner segment. The tooling mechanism may also include spacers to help align the liner segment properly with respect to the holes, where the attachment posts are to be fixed. An adhesive may be applied to the liner segment(s) and/or a base of the attachment posts, and then the attachment posts and liner segment can be fitted onto the tooling mechanism until the adhesive is sufficiently cured. In one embodiment, the holes in the inner shell of the helmet may be positioned in one or more same locations and/or orientations regardless of the size of the inner shell, so that any of the liner segments can fit within any size of the helmet shells. Alternatively, the holes maybe positioned in other locations.

Figure 23:
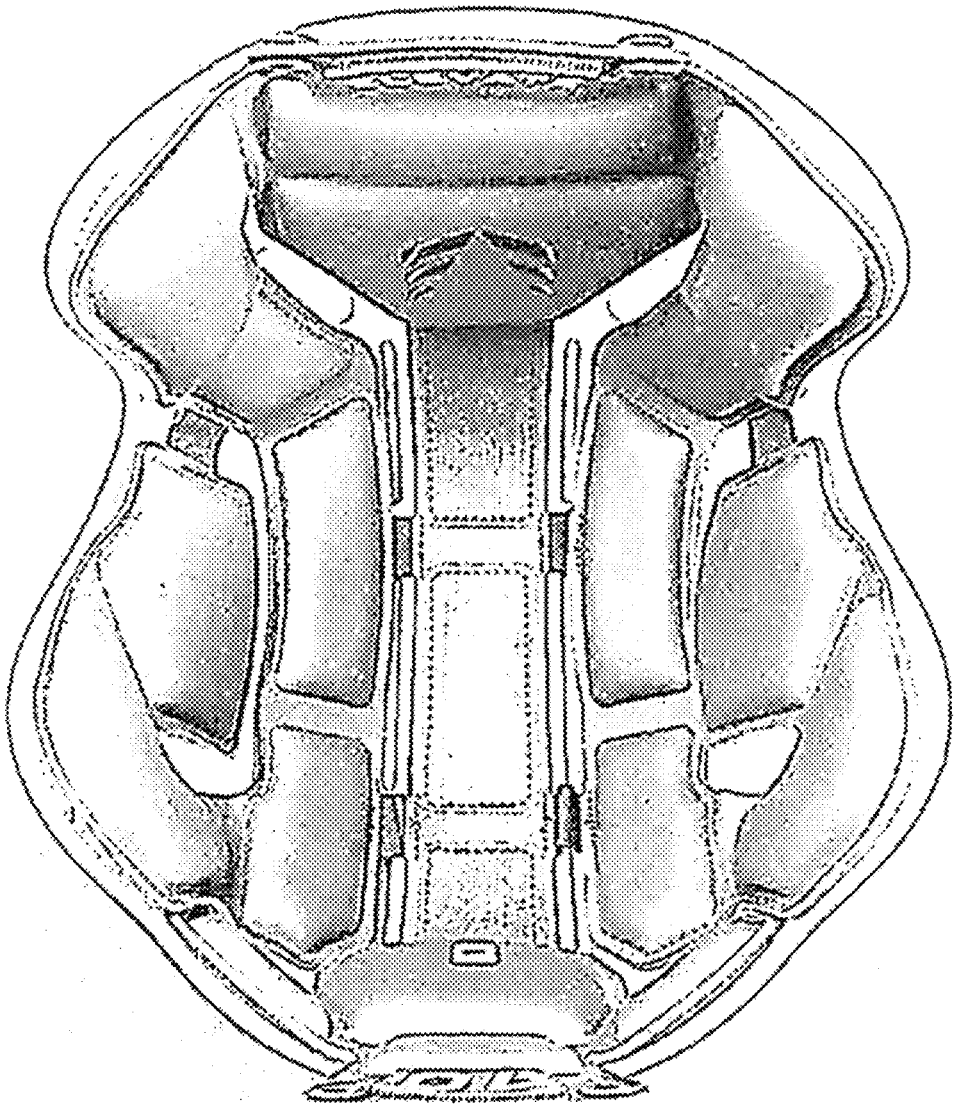
FIG. 23 depicts a view of another exemplary embodiment of an inner shell of a helmet with a modular liner system installed.

FIG. 23 illustrates another exemplary embodiment of an inner shell of a helmet with various liner segments (front pad, back pad, midline base pad, and side pads) installed into the inner shell. In various embodiments, tabs or other connectors can be provided and/or sewn into one or more of the liner segments. When installed into a helmet, the tabs can desirably line up with portions of neighboring segments, as indicated by the lines and pairs of dots in FIG. 18. In one embodiment, the tabs and corresponding liner surfaces can comprise a hook and loop material such as Velcro, or other attachable mechanism, such that adjacent liner segments can be connected when installed into a helmet. Attaching neighboring liner segments desirably provide more structural rigidity for the liner system and reduce slippage of the liner segments when the helmet is in use. Beneficially, the tabs may also provide a mechanism for the liners to be removed from the helmet.

Figure 24A:
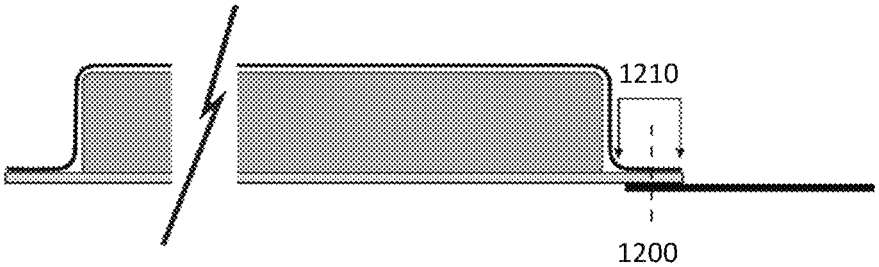
FIG. 24A is a side view of one exemplary embodiment of a liner pad with a tab sewn therein.
Figure 24B:
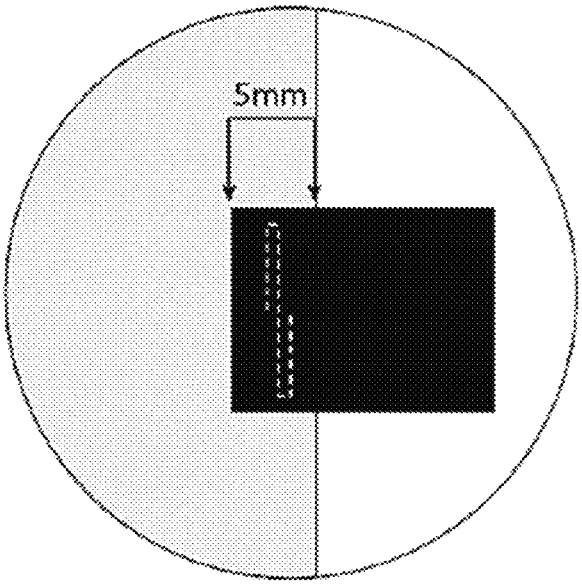
FIG. 24B is a back view of the liner pad of FIG. 24A, showing an exemplary stitching pattern used to connect a tab to a liner pad segment.

FIGS. 24A and 24B illustrate one exemplary embodiment wherein tabs can be sewn into a fabric portion of a liner segment. In this embodiment, the stitch line 1200 can extend along the center of the flange 1210, with the flange overlap having a width of 5 mm or greater. If desired, the stitched seam can comprise a plain lock stitch, with 7 stitches per inch, with an optional backtack at the beginning and/or end of the seam. In various other embodiments, the stitch can comprise a plain lock stitch of 6 or 8 or other number of stitches per inch.

Figure 25A:
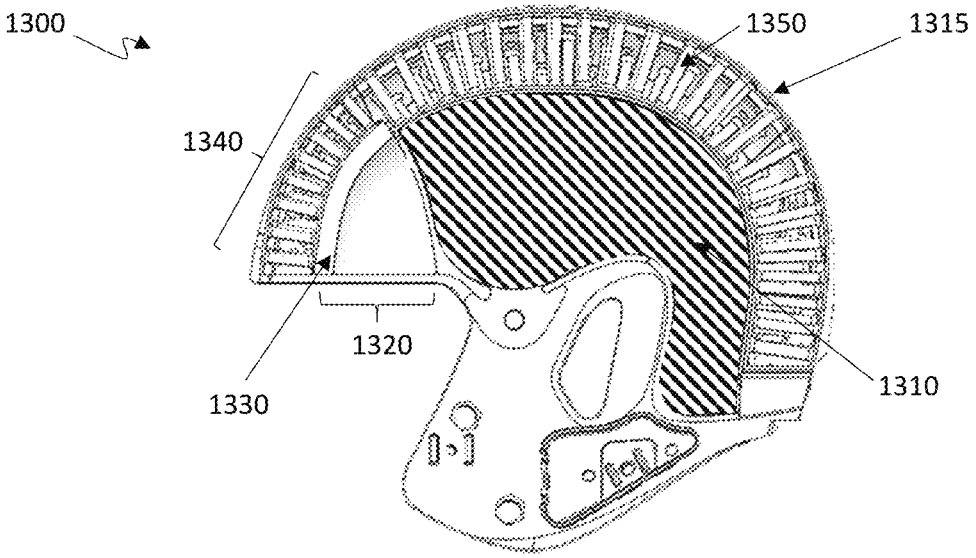
FIG. 25A depicts another exemplary embodiment of a helmet and associated components.

FIG. 25A depicts another exemplary embodiment of a helmet 1300 and associated components, in which a generally rigid inner shell 1310 (generally identified in cross-hatch in the drawing) will desirably cover a large proportion of the wearer's skull, with various modular impact liner components, reflex layers and a surrounding outer protective shell 1315, as previously described herein. One significant aspect of this design, however, is the presence of an open front section 1320 of the inner shell 1310, which allows the forehead and some associated skull structures of the wearer (not shown) to protrude forward of the inner shell 1310, with the forehead of the skull engaging an inner surface of an impact pad assembly 1330 located in the front of the helmet 1300. The impact pad assembly 1330 is, in turn, desirably connected to a frontal reflex layer 1340, which in this embodiment is configured to provide a different impact response than a main reflex layer 1350 which engages an outer surface of the inner shell 1310. By eliminating a frontal section of the inner shell, the present embodiment greatly enhances the impact absorbing and mitigating performance of the helmet, in that the impact pad assembly 1330, in contact with the wearer's skull, better engages the frontal reflex layer during an impact event, the frontal reflex layer can be particularized and/or optimized to protect against various specific types and/or degrees of impacts (as compared to the main reflex layer, for example), and the fit and comfort for the wearer is greatly improved in this design. Desirably, the forward-facing edges of the inner shell can be pulled back slightly around the entire perimeter of the wearer's face, with various liner components including edges that can wrap around the forward facing edges of the inner shell (not shown).

Figure 25B:
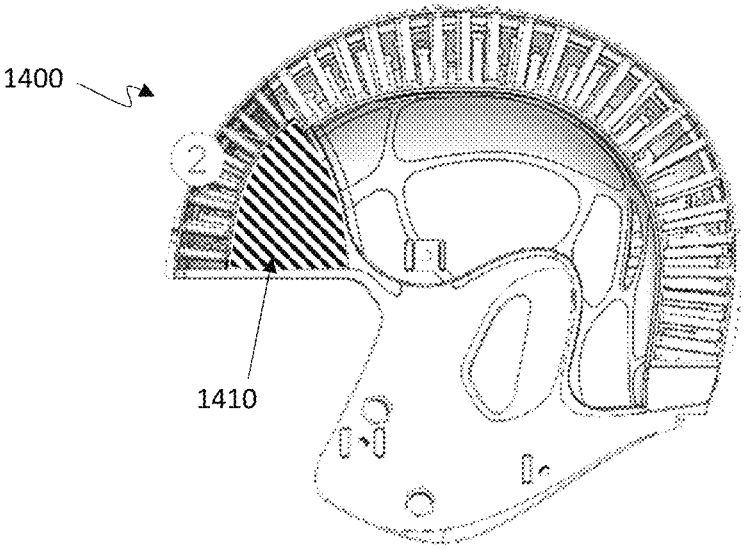
FIG. 25B depicts another exemplary embodiment of a helmet and associated components.

FIG. 25B depicts another exemplary embodiment of a helmet 1400 and associated components, in which an impact pad assembly 1410 (generally identified in cross-hatch in the drawing) is provided that significantly improves impact absorption and mitigation during an impact event. In this embodiment, the impact pad assembly can incorporate a replaceable pad comprising a high-density foam. In addition, the impact pad assembly can incorporate a urethane transition region at an outer periphery that surrounds and/or engages with one or more forward facing edges of an inner shell components, thereby reducing wearer contact with the transition region and providing added wearer comfort. In various embodiments, the impact pad assembly can incorporate features similar to those described in connection with the impact pad assemblies of FIGS. 2B and 10A through 10K.

Figure 25C:
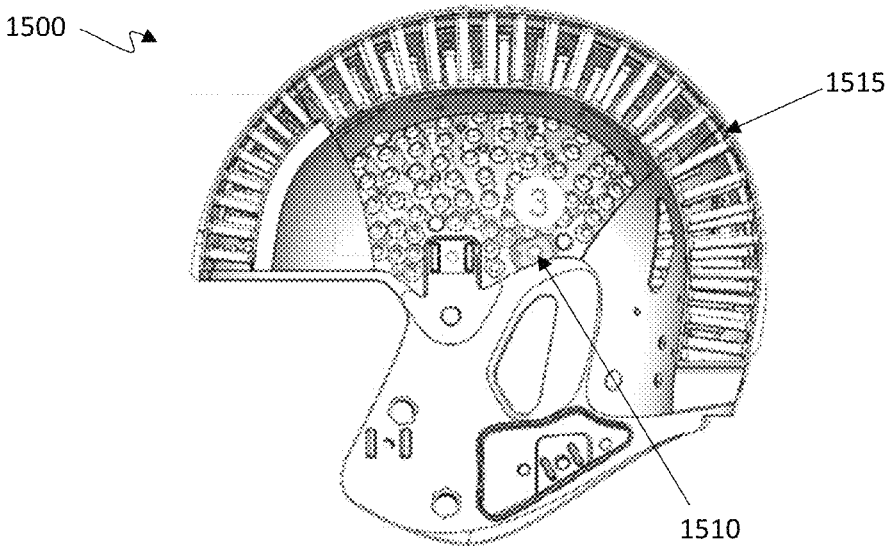
FIG. 25C depicts another exemplary embodiment of a helmet and associated components.

FIG. 25C depicts another exemplary embodiment of a helmet 1500 and associated components, in which a chinstrap connection point 1510 is positioned on an exterior position of the outer protective shell 1515, at a location above and proximate to a left earhole of the helmet. This design desirably allows the chinstrap to flex with the outer protective shell, thereby reducing the opportunity for chinstrap detachment and/or separation during an impact event.

Figure 25D:
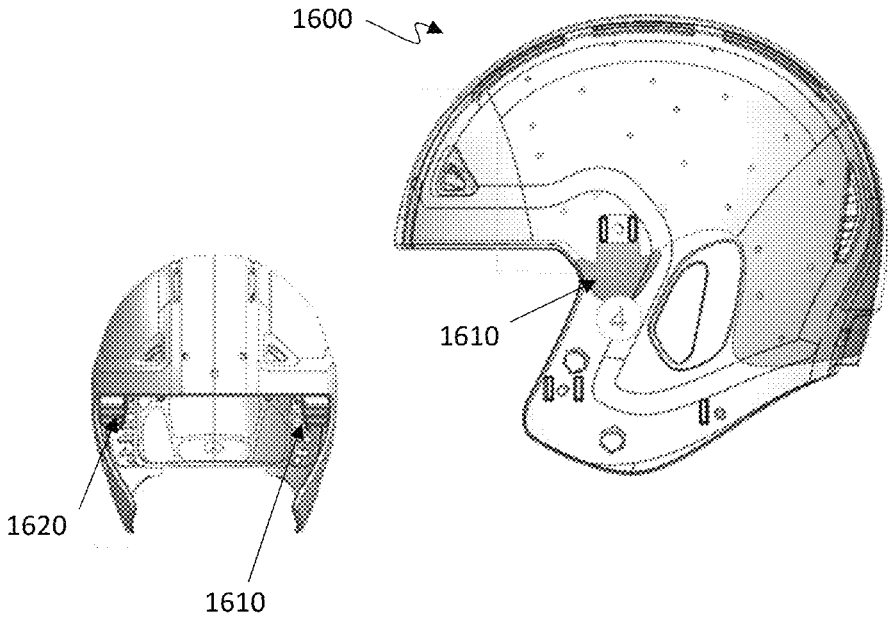
FIG. 25D depicts front and side views of another exemplary embodiment of a helmet and associated components.

FIG. 25D depicts frontal and side views of another exemplary embodiment of a helmet 1600 and associated components, in which an additional portion of left reflex layer 1610 and an additional portion of right reflex layer 1620 have been incorporated into the helmet. The left and right reflex layers in this embodiment are positioned below the inner shell, which desirably allows an inner surface of the layer to directly contact an inner shell and/or the wearer's skull directly.

Figure 25E:
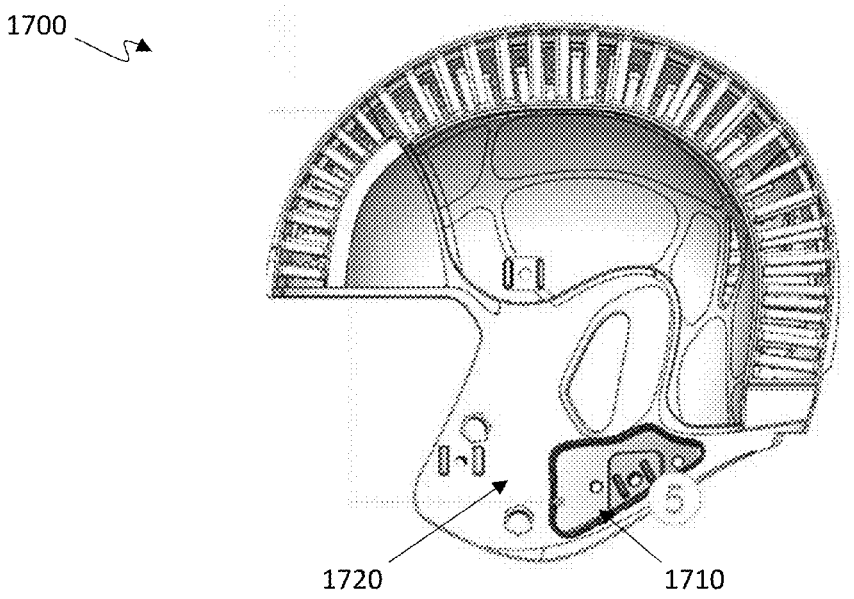
FIG. 25E depicts another exemplary embodiment of a helmet and associated components.

FIG. 25E depicts a side cross-sectional view of another exemplary embodiment of a helmet 1700 and associated components, in which an additional reinforcement plate 1710 has been incorporated into a lower portion of the outer protective shell 1720. In this embodiment, the plate 1710 desirably provides additional reinforcement and/or stiffening of the outer protective shell 1720 at the lower edge or "jaw bridge" of the helmet 1700, which further strengthens this location for mounting of a face shield (not shown) or other helmet features. If desired, additional securement features such as adhesives and/or enlarged/double T-nuts can be utilized to secure the plate to the shell 1720. Desirably, a pair of such reinforcement plates can be mounted to appropriate left and right sides of the helmet.

Liner Assemblies and Comfort Pads

Figure 26A:
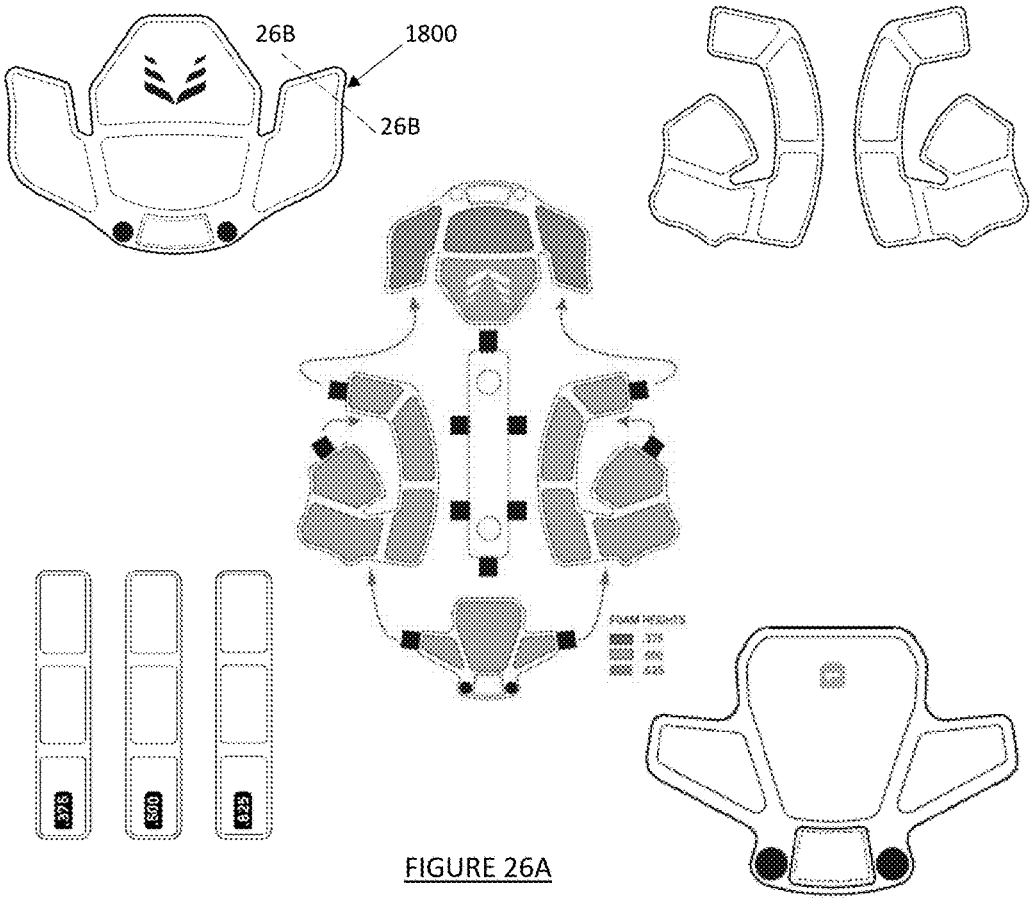
FIG. 26A depicts one exemplary embodiment of various liner components and associated pads.
Figure 26B:
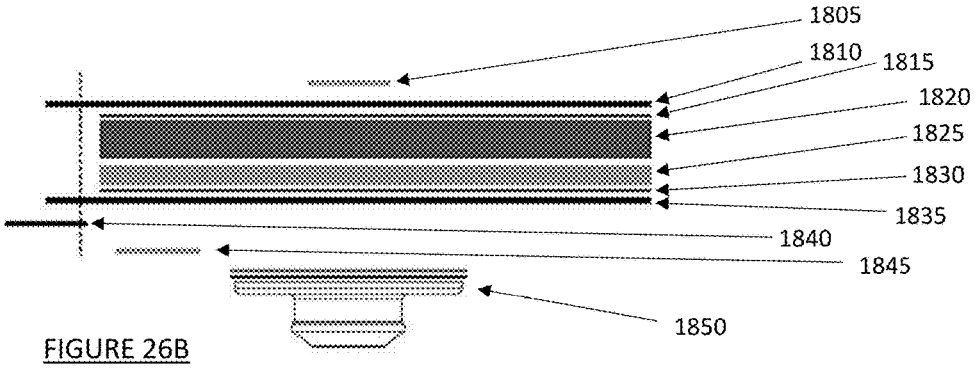
FIG. 26B depicts a cross-sectional view of one exemplary embodiment of a liner assembly pad and various material layers incorporated therein.

In various embodiments, including those depicted in FIG. 26A, the various liner components described herein can include a variety of arrangements and/or designs for the various pads and associated components. For example, FIG. 26B depicts a cross-sectional view of one exemplary embodiment of a back pad 1800 taken along line 26B-26B, with various materials and material layers that can be incorporated therein, including an optional plastic or fabric identification label layer 1805, an over-layer of soft leather, felt or a similar polymer 1810 (i.e., a skin contact layer), an adhesive layer 1815, a medium density foam layer 1820 (i.e., Confor slow recovery CF 47 medium foam commercially available from the Aearo Technologies division of 3M Corporation, St. Paul, Minn. USA—and/or other open-cell polyurethane foam), a layer of perforated and/or non-perforated impact resistant polymer foam 1825 (i.e., Poron XRD urethane based polymer—commercially available from Rogers Corporation of Rogers, Conn., USA), an under-layer of adhesive 1830, a flexible rubber sealant layer 1835, an optional elastic connector layer 1840, an optional plastic or fabric identification label layer 1845 and a cast substrate connector layer 1850. In a similar manner, the remaining components of the liner assemblies could comfort or impact absorbing pads and/or other structures incorporating a similar combination and/or arrangement of materials and/or other materials, if desired.

Although described in terms of a protective helmet that includes a rigid inner shell, a deformable outer shell, and a compressible structure therebetween, embodiments of the modular liner system can be used with other types of helmets. For example, the modular liner system may be used with a traditional helmet that has a rigid outer shell and larger padding inside it, where the liner system provides an improved fit to the head of a wearer. The modular liner system may also be used with other types of helmets and protective gear, such as bicycle helmets, baseball helmets, lacrosse helmets, and other sporting equipment, as well as nonsporting equipment like headgear designed for construction, military, or other non-sporting purposes.

INCORPORATION BY REFERENCE

The entire disclosure of each of the publications, patent documents, and other references referred to herein is incorporated herein by reference in its entirety for all purposes to the same extent as if each individual source were individually denoted as being incorporated by reference.

EQUIVALENTS

The invention may be embodied in other specific forms without departing from the spirit or essential characteristics thereof. The foregoing embodiments are therefore to be considered in all respects illustrative rather than limiting on the invention described herein. The scope of the invention is thus intended to include all changes that come within the meaning and range of equivalency of the descriptions provided herein.

Many of the aspects and advantages of the present invention may be more clearly understood and appreciated by reference to the accompanying drawings. The accompanying drawings are incorporated herein and form a part of the specification, illustrating embodiments of the present invention and together with the description, disclose the principles of the invention.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the disclosure herein.

The invention claimed is:

1. A protective helmet comprising:

an inner shell having a first inner surface and a first outer surface;

a plurality of padded inner lining elements attached to said first inner surface, the plurality of padded inner lining elements comprising a first layer of a first material and a second layer of a second material, the first and second materials having different rebound rates;

an outer shell having a second inner surface and a second outer surface, a first reflex layer positioned between the first outer surface and the second inner surface, the first reflex layer having a first plurality of impact absorbing structures, the first plurality of impact absorbing structures comprising a first plurality of filaments, each of the first plurality of filaments comprising a first end proximal to the first outer surface and a second end proximal to the second inner surface, and a second reflex layer positioned between the first outer surface and the second inner surface and positioned within an anterior portion of the protective helmet, the second reflex layer having a second plurality of impact absorbing structures, the second plurality of impact absorbing structures comprising a second plurality of filaments, a majority of the second plurality of filaments comprising an outer end proximate to the second inner surface.

2. The protective helmet of claim 1, wherein at least a portion of the second reflex layer is adjacent to an open anterior section of the inner shell.

3. The protective helmet of claim 1, wherein an average length of the second plurality of filaments is shorter than an average length of the first plurality of filaments.

4. The protective helmet of claim 1, wherein the inner shell further includes an open anterior section for accommodating a forehead of a wearer.

5. The protective helmet of claim 1, wherein the plurality of padded inner lining elements comprise a plurality of liner pad assemblies.

6. The protective helmet of claim 1, wherein the plurality of padded inner lining elements comprise one or more individual pads.

7. The protective helmet of claim 5, wherein the plurality of liner pad assemblies comprise a right pad assembly, a left pad assembly, a midline pad assembly a front pad assembly, a back pad assembly, a right jaw pad assembly, a left jaw pad assembly, and/or any combination thereof.

8. The protective helmet of claim 6, wherein the one or more individual pads comprise different individual pad thicknesses, individual pad shapes or individual pad sizes.

9. A protective helmet comprising:

an inner shell having a first inner surface and a first outer surface;

a plurality of padded inner lining elements attached to said first inner surface, the plurality of padded inner lining elements comprising a first layer of a first material and a second layer of a second material, the first and second materials having different rebound rates, wherein the plurality of padded inner lining elements comprise a first liner component adapted and configured to be secured to a medial side portion of the first inner surface and a second liner component adapted and configured to be secured to a lateral side portion of the first inner surface, the first and second liner components connected together by a flexible linkage, an outer shell having a second inner surface and a second outer surface, and a first reflex layer positioned between the first outer surface and the second inner surface, the first reflex layer comprising a first plurality of filaments, each of the first plurality of filaments comprising a first end proximal to the first outer surface and a second end proximal to the second inner surface.

10. The protective helmet of claim 9, wherein the inner shell further includes an open anterior section for accommodating a forehead of a wearer.

11. The protective helmet of claim 9, wherein the flexible linkage includes an elastic portion.

12. The protective helmet of claim 9, wherein the flexible linkage is releasably coupled to the first liner component and the second liner component.

13. The protective helmet of claim 9, wherein the plurality of padded inner lining elements comprise a plurality of liner pad assemblies.

14. The protective helmet of claim 9, wherein the plurality of padded inner lining elements comprise one or more individual pads.

15. The protective helmet of claim 9, wherein the first material or the second material is an impact hardening material.

16. The protective helmet of claim 13, each of the plurality of liner pad assemblies are affixed onto a baseplate.

17. The protective helmet of claim 9, wherein the plurality of padded liner elements further comprise an attachment mechanism.

18. The protective helmet of claim 9, wherein the protective helmet further comprises a a second reflex layer positioned between the first outer surface and the second inner surface and positioned within an anterior portion of the protective helmet, the second reflex layer comprising a second plurality of filaments, each of the second plurality of filaments comprising an outer end proximate to the second inner surface.

* * * * *